US011485536B2

(12) United States Patent
Bulls, Jr.

(10) Patent No.: US 11,485,536 B2
(45) Date of Patent: Nov. 1, 2022

(54) MULTI PIECE CORRUGATED BOX ASSEMBLIES, BLANKS, AND SYSTEMS FOR HEAVY BAG IN BOX DISPENSED PRODUCTS

(71) Applicant: Georgia-Pacific Corrugated LLC, Atlanta, GA (US)

(72) Inventor: Carl Anthony Bulls, Jr., Norcross, GA (US)

(73) Assignee: GEORGIA-PACIFIC CORRUGATED LLC, Atlanta, GA (US)

( * ) Notice: Subject to any disclaimer, the term of this patent is extended or adjusted under 35 U.S.C. 154(b) by 308 days.

(21) Appl. No.: 16/906,136

(22) Filed: Jun. 19, 2020

(65) Prior Publication Data

US 2021/0253294 A1 Aug. 19, 2021

Related U.S. Application Data

(60) Provisional application No. 62/976,550, filed on Feb. 14, 2020.

(51) Int. Cl.
*B65D 5/32* (2006.01)
*B65D 5/70* (2006.01)
(Continued)

(52) U.S. Cl.
CPC ..... *B65D 5/326* (2013.01); *B65D 5/067* (2013.01); *B65D 5/328* (2013.01); *B65D 5/703* (2013.01);
(Continued)

(58) Field of Classification Search
CPC ..... B65D 5/326; B65D 5/703; B65D 77/065; B65D 83/0055; B65D 2231/001;
(Continued)

(56) References Cited

U.S. PATENT DOCUMENTS 1,809,953 A 6/1931 White
2,485,816 A 10/1949 Dalsemer
(Continued)

FOREIGN PATENT DOCUMENTS

CA 2015175 A1 10/1991
CA 2407375 C 12/2006
(Continued)

OTHER PUBLICATIONS

"2017 Cave de Pomerols Picpoul de Pinet HB La Petite Frog Bag in Box 3.0 L;" retreived Aug. 16, 2019 from https://lawineco.com/2017-cave-de-pomerols-picpoul-de-pinet-hb-la-petite-frog-bag-in-box-30-l-w-19105.
(Continued)

*Primary Examiner* — Frederick C Nicolas
(74) *Attorney, Agent, or Firm* — Nelson Mullins Riley & Scarborough LLP

(57) ABSTRACT

Corrugated box assemblies, blanks, and systems for individually shipping a bag of liquid stored therein and converting an inner portion into a bag-in-box dispenser are provided. An example box assembly includes an inner portion including a plurality of walls. The inner portion includes an interior configured to receive and store the bag of liquid, which may range from about 3 to 6 gallons. The inner portion further includes a removable perforation feature defined by a series of perforations on at least one of a front wall and a front top flap extending from the front wall. A top portion and a bottom portion each include a plurality of walls that, when formed, define an opening sized to fit around the inner portion. The box assembly may be configured to pass individual box shipping test standards, such as ISTA and SIOC test standards. Methods of forming the box assembly are also provided.

25 Claims, 13 Drawing Sheets

(51) Int. Cl.

| | |
|---|---|
| ***B65D 83/00*** | (2006.01) |
| ***B65D 77/06*** | (2006.01) |
| ***B65D 5/06*** | (2006.01) |
| *B31B 105/00* | (2017.01) |

(52) U.S. Cl.

CPC ..... *B65D 77/065* (2013.01); *B65D 83/0055* (2013.01); *B31B 2105/0022* (2017.08); *B65D 2231/001* (2013.01); *B65D 2517/0008* (2013.01)

(58) Field of Classification Search

CPC ..... B65D 2517/0008; B65D 5/328; B65D 77/067; B31B 2105/0022

See application file for complete search history.

(56) References Cited

U.S. PATENT DOCUMENTS

| | | | | |
|---|---|---|---|---|
| 2,671,600 | A | 3/1954 | Leavitt | |
| 2,799,440 | A | 7/1957 | Frederich et al. | |
| 2,936,944 | A | 5/1960 | Moore | |
| 2,973,119 | A | 2/1961 | Parker | |
| 3,145,900 | A | 8/1964 | Franklin | |
| 3,157,345 | A | 11/1964 | George | |
| 3,521,806 | A | 7/1970 | Esty | |
| 3,559,867 | A | 2/1971 | Muskopf et al. | |
| 3,756,471 | A | 9/1973 | Wissman | |
| 4,165,024 | A | 8/1979 | Oswalt et al. | |
| 4,322,018 | A | 3/1982 | Rutter | |
| 4,585,143 | A | 4/1986 | Fremow et al. | |
| 4,666,059 | A | 5/1987 | Nordstrom | |
| 4,673,125 | A | 6/1987 | Weaver | |
| 4,753,348 | A | 6/1988 | Patrick et al. | |
| RE33,128 | E * | 12/1989 | Nordstrom | B65D 77/061 222/105 |
| 5,042,682 | A | 8/1991 | Ritter et al. | |
| 5,143,278 | A | 9/1992 | Petriekis et al. | |
| 5,148,939 | A | 9/1992 | Roser | |
| 5,186,359 | A | 2/1993 | Brown et al. | |
| 5,351,849 | A | 10/1994 | Jagenburg | |
| 5,356,029 | A | 10/1994 | Hogan | |
| 5,419,485 | A | 5/1995 | Petriekis et al. | |
| 5,555,982 | A * | 9/1996 | Kuhn | B65D 5/54 206/746 |
| 5,638,978 | A | 6/1997 | Cadiente | |
| 5,639,015 | A | 6/1997 | Petriekis et al. | |
| 6,168,074 | B1 * | 1/2001 | Petriekis | B65D 77/065 229/122.26 |
| 6,223,981 | B1 * | 5/2001 | Gunder | B65D 5/5405 229/242 |
| 6,637,623 | B2 * | 10/2003 | Muise | B65D 5/5045 222/530 |
| 6,827,237 | B2 | 12/2004 | Yorn et al. | |
| 7,264,147 | B1 | 9/2007 | Benson et al. | |
| 7,571,835 | B2 * | 8/2009 | Hill | B65D 5/10 222/105 |
| 7,708,186 | B2 | 5/2010 | Pawlick | |
| 8,025,206 | B2 | 9/2011 | Wisecarver et al. | |
| 8,025,208 | B2 | 9/2011 | Wisecarver et al. | |
| 8,091,768 | B2 | 1/2012 | Wisecarver et al. | |
| 8,261,964 | B2 | 9/2012 | Raupach et al. | |
| D668,951 | S | 10/2012 | Voelker | |
| D670,170 | S | 11/2012 | Voelker | |
| 8,418,912 | B1 | 4/2013 | Goodrich | |
| 8,469,258 | B2 | 6/2013 | Timbrook et al. | |
| 8,490,858 | B2 | 7/2013 | Timbrook et al. | |
| 8,622,240 | B2 | 1/2014 | Krasucki et al. | |
| 8,631,971 | B2 | 1/2014 | Edwards | |
| 8,651,365 | B2 | 2/2014 | Lymn et al. | |
| D703,529 | S | 4/2014 | Voelker | |
| 8,746,541 | B2 | 6/2014 | Spivey, Sr. et al. | |
| 8,844,797 | B2 | 9/2014 | Smith | |
| 8,939,351 | B2 | 1/2015 | Goudreau et al. | |
| D725,465 | S | 3/2015 | Voelker | |
| 9,114,921 | B2 | 8/2015 | Smith | |
| 9,156,579 | B2 | 10/2015 | Pinkstone | |
| 9,193,511 | B2 | 11/2015 | Graham | |
| 9,656,790 | B2 | 5/2017 | Smith | |
| 9,856,076 | B2 | 1/2018 | Troxell | |
| 9,862,532 | B2 | 1/2018 | Mcrae | |
| 9,994,355 | B2 | 6/2018 | Ishikawa et al. | |
| 10,118,751 | B2 | 11/2018 | Couvillon et al. | |
| 10,131,480 | B2 | 11/2018 | Mcrae | |
| 10,189,623 | B2 | 1/2019 | Voelker | |
| 10,384,849 | B2 | 8/2019 | Mckenna | |
| 10,882,677 | B2 | 1/2021 | Malott | |
| 2005/0150939 | A1 | 7/2005 | Fakes et al. | |
| 2006/0097005 | A1 | 5/2006 | Hill | |
| 2006/0144910 | A1 * | 7/2006 | Wachter | B65D 77/067 229/242 |
| 2006/0243783 | A1 * | 11/2006 | Spivey | B65D 5/5009 229/242 |
| 2007/0152028 | A1 * | 7/2007 | McGowan | B65D 5/5014 229/242 |
| 2007/0164092 | A1 | 7/2007 | Biundo | |
| 2008/0087713 | A1 | 4/2008 | Deniston et al. | |
| 2008/0116206 | A1 | 5/2008 | Pawlick | |
| 2010/0187294 | A1 | 7/2010 | Raupach et al. | |
| 2011/0036864 | A1 | 2/2011 | McKenna | |
| 2011/0095037 | A1 | 4/2011 | Falkenström | |
| 2011/0111938 | A1 | 5/2011 | Smith | |
| 2012/0205396 | A1 | 8/2012 | Edwards | |
| 2014/0083340 | A1 | 3/2014 | Dull et al. | |
| 2015/0353256 | A1 | 12/2015 | Smith | |
| 2016/0096664 | A1 | 4/2016 | Krieger et al. | |
| 2016/0347499 | A1 | 12/2016 | Machin | |
| 2017/0001752 | A1 | 1/2017 | Ishikawa et al. | |
| 2017/0210533 | A1 | 7/2017 | Couvillon et al. | |
| 2018/0155106 | A1 | 6/2018 | Troxell | |
| 2019/0016081 | A1 | 1/2019 | Widner | |
| 2019/0084744 | A1 | 3/2019 | McRae | |
| 2019/0152671 | A1 | 5/2019 | Voelker | |
| 2019/0152673 | A1 | 5/2019 | Hagihara | |
| 2019/0210860 | A1 | 7/2019 | Bourke | |
| 2019/0256271 | A1 | 8/2019 | Smith | |
| 2020/0108993 | A1 | 4/2020 | Malott et al. | |
| 2020/0108994 | A1 | 4/2020 | Bohache et al. | |
| 2020/0108995 | A1 | 4/2020 | Ficke et al. | |
| 2020/0231354 | A1 | 7/2020 | Aikio | |
| 2020/0255204 | A1 | 8/2020 | Belgya | |

FOREIGN PATENT DOCUMENTS

| | | | |
|---|---|---|---|
| CA | 2705103 | A1 | 5/2009 |
| CA | 2767778 | A1 | 1/2011 |
| CA | 2599383 | C | 11/2011 |
| CA | 138748 | S | 2/2012 |
| CA | 2572778 | C | 3/2012 |
| CA | 2812527 | A1 | 3/2012 |
| CA | 2763473 | C | 11/2012 |
| CA | 2795701 | C | 7/2014 |
| CA | 2795773 | C | 7/2014 |
| CA | 2693597 | C | 11/2015 |
| CA | 2952085 | A1 | 2/2016 |
| CA | 2893392 | C | 1/2017 |
| CA | 2720581 | C | 12/2017 |
| CA | 2790821 | C | 5/2019 |
| DE | 20318053 | U1 | 2/2004 |
| EP | 1770012 | A1 | 4/2007 |
| EP | 1826130 | B1 | 12/2011 |
| EP | 2436613 | A1 | 4/2012 |
| EP | 2631196 | A1 | 8/2013 |
| EP | 2716563 | A1 | 4/2014 |
| FR | 2857943 | B1 | 6/2006 |
| GB | 1046900 | A | 10/1966 |
| GB | 1161713 | A | 8/1969 |
| GB | 2322118 | A | 8/1998 |
| JP | 2005263239 | A | 9/2005 |
| JP | 2006335453 | A | 12/2006 |
| JP | 2011079528 | A | 4/2011 |
| JP | 2019014527 | A | 1/2019 |
| KR | 20110094851 | A | 8/2011 |
| MX | 2007010643 | A | 10/2007 |

(56) References Cited

FOREIGN PATENT DOCUMENTS

| | | | |
|---|---|---|---|
| MX | 2012000950 | A | 2/2012 |
| MX | 2012009930 | A | 10/2012 |
| MX | 2015011168 | A | 11/2016 |
| WO | 2004089765 | A1 | 10/2004 |
| WO | 2004108555 | A1 | 12/2004 |
| WO | 2005019063 | A1 | 3/2005 |
| WO | 2007022304 | A2 | 2/2007 |
| WO | 2007118992 | A1 | 10/2007 |
| WO | 2011106509 | A1 | 9/2011 |
| WO | 2014037743 | A1 | 3/2014 |
| WO | 2018150087 | A1 | 8/2018 |

OTHER PUBLICATIONS

"6-Amazon.com—Over Boxing;" International Sage Tranist Association; Overview of Project; 2018; pp. 1-8, 17 pp.

"Badger Mountain 3 Liter Box N.S.A. Pure Red, Columbia Valley, USA;" retreived Aug. 16, 2019 from https://www.wine-searcher.com/find/badger+mnt+three+box+n+s+a+pure+red+columbia+valley+washington+usa.

"Bar Beverages King Kamehameha Craft Pineapple Juice (3 Gallon Bag-in-Box Syrup Concentrate)—Box Pours 15 Gallons of Pineapple Juice—Use with Bar Gun, Soda Fountain or SodaStream;" retreived Aug. 16, 2019 from https://www.amazon.com/Kamehameha-Craft-Pineapple-Gallon-Concentrate.

"Bizzy Organic Cold Brew Coffee—Ready-to-Drink—128 fl oz Bag-in-box—Coffee on Tap;" retreived Aug. 16, 2019 from https://www.amazon.com/Bizzy-Organic-Coffee-Ready-Drink.

"Boris Jelzin Vodka Bag in Box 3 Litre 37.5%;" retreived Aug. 16, 2019 from https://www.berevita.com/en/boris-ielzin-vodka-bib-3-liter.

"Corto Extra Virgin Olive Oil From California, (3 Liter Fresh Sealed Bag in Box);" retreived Aug. 16, 2019 from https://www.amazon.com/Corto-Extra-Virgin-California-Sealed/dp/B00YG1DWP4/ref=sr_1_3?keywords=Corto+Extra+Virgin+Olive+Oil&qid=1565964525&s=gateway&sr=8-3.

"CRC Smartwasher Industrial Grade Liquid Cleaning Solution, 5 Gallon Jug, Light Brown;" retreived Aug. 16, 2019 from https://www.amazon.com/CRC-Smartwasher-Industrial-Cleaning-Solution/dp/B002A09KYK/ref=sr_1_1?keywords=CRC+Smartwasher+Industrial+Grade+Liquid+Cleaning+Solution%2C+5+Gallon+Jug&qid=1565963158&s=gateway&sr=8-1.

"Diet Coke Bag-In-Box Fountain Syrup (5 gal.);" retreived Aug. 16, 2019 from https://www.amazon.com/Diet-Coke-Bag-Fountain-Syrup/dp/B0042RROR4/ref=asc_df_B0042RROR4/?tag=hyprod-20&linkCode=df0&hvadid=312134195473&hvpos=1o2&hvnetw=g&hvrand=6452231474116626581&hvpone=&hvptwo=&hvqmt=&hvdev=c&hvdvcmdl=&hvlocint=&hvlocphy=9010433&hvtargid=pla-612741909571&th=1.

"DRK98390—Floor Science Floor Care Finish, 5 Gallon Bag-in-Box;" retreived Aug. 16, 2019 from https://www.amazon.com/DRK98390-Science-Finish-Bag-Box/dp/B00V9LWK3O/ref=sr_1_1?keywords=DRK98390+-+floor+-science+floor+care+finish%2C+5+gallon&qid=1565963435&s=gateway&sr=8-1.

"Fibre Box Handbook: 75th Anniversary Edition;" Fibre Box Association; pp. 21-40, 172 pp. May 28, 2015.

"Franklin Cleaning Technology F219025 Green Option Floor Stripper, Liquid, 5 Gallon Box;" retreived Aug. 16, 2019 from https://www.amazon.com/Franklin-Cleaning-Technology-Green-Option/dp/B004EHZ992/ref=sr_1_1?keywords=Franklin+Cleaning+Technology+F219025+Green+Option&qid=1565963713&s=gateway&sr=8-1.

"Ketchup Vol Pak 3 Gallon;" retreived Aug. 16, 2019 from https://www.foodservicedirect.com/ketchup-vol-pak-3-gallon-10911.html.

"LouAna Bag-in-Box Premium Yellow Colored Coconut Popping Oil | 35 Pound Food Service Pack;" retreived Aug. 16, 2019 from https://www.amazon.com/LouAna-Premium-Colored-Coconut-Popping/dp/B07RRFKNBD/ref=sr_1_3?keywords=LouAna+Bag-in-box+premium+yellow+colored+Coconut+Popping+oil&qid=1565964079&s=gateway&sr=8-3.

"Maple Valley Organic Maple Syrup, 3-Gallon Bag-In-Box, Grade A (Amber Color, Rich Taste);" retreived Aug. 16, 2019 from https://www.amazon.com/Maple-Valley-Organic-Syrup-3-Gallon/dp/B007N78LG8/ref=sr_1_3?keywords=Maple+Valley+Organic+Maple+Syrup%2C+3-gallon+bag-in-box&qid=1565964634&s=gateway&sr=8-3.

"Narvon 3 Gallon Bag in Box Apple Juice Syrup;" retreived Aug. 16, 2019 from https://www.webstaurantstore.com/narvon-3-gallon-bag-in-box-apple-juice-syrup/515BIBJAPPLE.html.

"Olio de Carlo il Classico 5L Bag-in-Box Cold Extracted Italian Extra Virgin Olive Oil 5 Liters (169 oz);" retreived Aug. 16, 2019 from https://www.amazon.com/Olio-Carlo-Classico-Italian-Virgin/dp/B075FC2Q9L/ref=sr_1_1?keywords=Olio+de+Carlo+il+Classico+5L+Bag-in-Box+Italian+Extra+Virgin+Olive+Oil&qid=1565964375&s=gateway&sr=8-1.

"Opening Black Box Wines;" retreived Aug. 16, 2019 from https://www.blackboxwines.com/why-boxed-wine/#box-instructions.

"Popcorn Supply | Bag-In-Box Buttery Topping | by Gold Medal 2653 | 35 lbs;" retreived Aug. 16, 2019 from https://www.amazon.com/Popcorn-Supply-Buttery-Topping-Medal/dp/B07V25QD4G/ref=sr_1_1?keywords=gold+medal-bag-in-box+buttery+topping&qid=1565963993&s=gateway&sr=8-1.

"Powerized Formula Glass/Surface Cleaner, 5gal Bag-in-Box Dispenser;" retreived Aug. 16, 2019 from https://www.amazon.com/Powerized-Formula-surface-Cleaner-Dispenser/dp/B079ZNGDTF/ref=sr_1_11?keywords=Powerized+Formula+Glass%2FSurface+Cleaner%2C+5gal+Bag-In-Box+Dispenser&qid=1565961872&s=gateway&sr=8-11.

"Ravenol J1A1525-BiB HCL 5W-30 Fully Synthetic Motor Oil—Longlife-01, MB 229.5 (20L (Bag-in-Box));" retreived Aug. 16, 2019 from https://www.amazon.com/Ravenol-J1A1525-BiB-HCL-5W-30-Synthetic/dp/B01K5VUCD8/ref=sr_1_3?keywords=Ravenol+J1A1525-BiB+HCL+5W-30+Fully+Synthetic+Motor+Oil&qid=1565964200&s=gateway&sr=8-3.

"Sanitizer, Quaternary D7 Liquid Bag-In-Box Plastic;" retreived Aug. 16, 2019 from https://www.amazon.com/SANITIZER-QUATERNARY-LIQUID-BAG-PLASTIC/dp/B00FIUBZP6/ref=sr_1_3?keywords=Sanitizer%2C+Quaternary+D7+Liquid+bag-in-box+plastic&qid=1565964299&s=gateway&sr=8-3.

"Sprite Bag-In-Box Fountain Syrup 5 gal. A1;" retreived Aug. 16, 2019 from https://www.amazon.com/Sprite-Bag-Box-Fountain-Syrup/dp/B07DPPTQQY/ref=sr_1_3?keywords=Sprite+Bag-in-Box+Fountain+Syrup+5+gal&qid=1565962415&s=gateway&sr=8-3.

"Statguard Dissipative Bag-In-Box Floor Finish, 5 Gallons;" retreived Aug. 16, 2019 from https://www.amazon.com/Statguard-Dissipative-Floor-Finish-Gallons/dp/B072XTY1XW/ref=sr_1_2?keywords=Statguard+Dissipative+Bag-in-Box+Floor+Finish&qid=1565963796&s=gateway&sr=8-2.

"Suntory natural water 10L bag-in-box faucet;" retreived Aug. 16, 2019 from https://www.amazon.com/Suntory-natural-water-bag-faucet/dp/B001JEOFUC/ref=sr_1_3?keywords=Suntory+natural+water+10L+bag-in-box+faucet&qid=1565964723&s=gateway&sr=8-3.

"Syrup, Fountain Orange Gatorade Bag-In-Box;" retreived Aug. 16, 2019 from https://www.amazon.com/SYRUP-FOUNTAIN-ORANGE-GATORADE-BAG-IN-BOX/dp/B00BIR3CZ4/ref=sr_1_3?keywords=Syrup%2C+Fountain+Orange+Gatorade+Bag-in-Box&qid=1565962114&s=gateway&sr=8-3.

"Tide Laundry Detergent Liquid Eco-Box, Concentrated, Original Scent, 105 oz, HE Compatible, 96 Loads;" retreived Aug. 16, 2019 from https://www.amazon.com/Tide-Laundry-Detergent-Eco-Box-Original/dp/B072M3HHMX/ref=sr_1_3?crid=3CXG6Z9ZO2KX8&keywords=tide+laundry+detergent+liquid+eco-box&qid=15659633708s=gateway&sprefix=Tide+laundry+detergent+liquid+e%2Caps%2C153&sr=8-3.

"Vanilla Cream Soda Syrup (1 gallon);" retreived Aug. 16, 2019 from https://www.amazon.com/Vanilla-Cream-Soda-Syrup-gallon/dp/B008HKDLLK/ref=sr_1_3?keywords=Vanilla+Cream+Soda+Syrup&qid=1565962626&s=gateway&sr=8-3.

"Wandering Bear Organic Cold Brew Coffee On Tap, Straight Black, No Sugar, Always Fresh and Ready to Drink, Not a Con-

(56) References Cited

OTHER PUBLICATIONS centrate, 96 fl oz;" retreived Aug. 16, 2019 from https://www.amazon.com/Wandering-Bear-Organic-Coffee-Straight/dp/B07CZ37V8N/ref=sr_1_3?crid=R0YZX5ETC7EF&keywords=wandering%2Bbear%2Borganic%2Bcold%2Bbrew%2Bcoffee&qid=15659620338s=gateway&sprefix=Wandering%2BBear%.

"Windex Powerized Formula Glass/Surface Cleaner, 5 Gallon Bag-in-Box Dispenser;" retreived Aug. 16, 2019 from https://www.amazon.com/Windex-Powerized-Formula-Surface-Dispenser/dp/B00BPPL4WW/ref=sr_1_1?keywords=windex+powerized+formula+glass%2Fsurface+cleaner%2C+5+gallon+bag-in-box+dispenser&qid=1565961639&s=gateway&sr=8-1.

"Windex, SC Johnson Professional, Glass & Surface Cleaner with Ammonia-D, 5 Gallon;" retrieved Aug. 16, 2019 from https://www.amazon.com/Windex%C2%AE-Glass-Cleaner-5-Gallon/dp/B075CNL31F/ref=sr_1_fkmr0_1?keywords=windex%2CSC+Johnso+Professional%2C+Glass+%26+Surface+Cleaner+with+Ammounia-D%2C+5+Gallon&qid=1565961780&s=gateway&sr=8-1-fkmr0.

"Wine in Box;" Colferai; retreived Aug. 16, 2019 from https://www.colferai.com/products/wine-in-box/.

Chrisman; "New Boxed Whiskey, Tequila, and Vodka Are Joining the Boxed Wine Party;" Thrillist; May 2, 2018; retreived Aug. 16, 2019 from https://www.thrillist.com/news/nation/black-box-boxed-vodka-tequila-whiskey.

Hayes; "2 Sommeliers Taste All of Franzia's Classy Boxed Wines;" Thrillist; May 12, 2015; retreived Aug. 16, 2019 from https://www.thrillist.com/drink/nation/sommeliers-drink-franzia-the-world-s-most-popular-wine-boxed-wine.

Kiely; "Bag-in-a-box ultra-premium vodka debuts in US;" The Spririts Businesss; Jun. 25, 2015; retreived Aug. 16, 2019 from https://www.thespiritsbusiness.com/2015/06/bag-in-a-box-ultra-premium-vodka-debuts-in-us/.

Moore; "Bag-in-box wine is back, so order in a bagnum;" The Telegraph; Jul. 9, 2016; retreived Aug. 16, 2019 from https://www.telegraph.co.uk/food-and-drink/wine/bag-in-box-wine-is-back-so-order-in-a-bagnum/.

Ruettimann; "TopFlow: the incredible innovative patented boxed wine technology;" Swedbrand Group; Oct. 9, 2015; retreived Aug. 16, 2019 from http://www.swedbrand-group.com/blog/topflow-the-incredible-innovative-boxed-wine-technology.

International Search Report and Written Opinion for PCT application No. PCT/IB2020/055818, dated Sep. 3, 2020, 11 pages.

International Search Report and Written Opinion for PCT application No. PCT/IB2020/055803, dated Sep. 4, 2020, 13 pages.

International Search Report and Written Opinion received for PCT Application No. PCT/IB2020/055814, dated Oct. 14, 2020, 11 pages.

* cited by examiner

MULTI PIECE CORRUGATED BOX ASSEMBLIES, BLANKS, AND SYSTEMS FOR HEAVY BAG IN BOX DISPENSED PRODUCTS

BACKGROUND

Bag-in-box dispensers provide a user access to dispense liquid product (e.g., soap, oil, cleaner, wine, etc.) from a bag that is held within a box. In some cases, a user accesses a dispensing tap (e.g., valve, opening, nozzle, etc.) on the bag (often extending through a hole in the box) to dispense liquid from the bag, while the majority of the bag is stored within the box. Conventional box designs for bag-in-box dispensers include a corrugated box that is designed to be shipped on a pallet in an upright orientation (e.g., with other like boxes/product). Then, each bag-in-box product is taken off the pallet for use and/or stocking on a shelf for sale. Notably, shipping and handling under such circumstances typically puts predictable and largely unidirectional stress on the box such that box designs are directed toward maintaining the box and bag stored inside in working order through this distribution model to the final destination. For example, the strength characteristics for the box can be designed with the knowledge that the box will only be shipped in the upright orientation.

BRIEF SUMMARY

Example embodiments of the present disclosure generally relate to box assemblies and, more particularly to multi-piece corrugated box assemblies designed to hold an inner portion safely inside that is convertible to a bag-in-box dispenser.

Some embodiments of the present disclosure are directed to corrugated box assemblies that are designed to withstand the individual e-commerce shipping environment, which includes the same shipping and handling that occurs for other types of boxes in this environment (e.g., throwing the boxes, dropping the boxes in all orientations, vibration within a transport vehicle with weight stacked on top). Importantly, in the individual e-commerce shipping environment, there is no predictable orientation for the box design, and all of the above (and other) circumstances occur in all orientations. Thus, while prior box designs for bag-in-box dispensers could predict their orientation (e.g., upright) and had the benefit of relatively safe/professional handling and transfer, the present disclosure takes into account all of those uncertainties and likely occurrences to still deliver an intact box to the final destination.

For bag-in-box products, it is very important to keep the box (and any perforations) intact during shipping because otherwise the liquid product in the bag may spill out if the bag breaks, rips, or tears, as the bag is more susceptible to breaking and/or leaking if the box is compromised/weakened. That situation is of extra concern because spilled liquid can cause significant damage to other boxes or transportation equipment (e.g., trucks, conveyors, warehouse flooring, etc.) during shipping and is difficult to clean (e.g., in comparison to non-liquid products being shipped). In this regard, the box assembly designs of the present disclosure are engineered to withstand and pass various standardized distribution sequences that are specifically designed to replicate harsh conditions that a box goes through during individual e-commerce shipping (e.g., through various known consumer-based shipping services). Such example safety test standards include the International Safe Transit Association (ISTA) test standards, including the Ship In Own Container (SIOC) test protocols. In such a regard, the resulting box assembly designs of the present disclosure are the product of significant testing, as many other designs were disregarded after failing such tests.

Some embodiments of the present disclosure provide example box assembly designs for safely and successfully transporting a heavy bag of liquid inside an inner portion of the box assembly, thus enabling conversion into a bag-in-box dispenser and preservation of the inner portion. For example, various box assembly designs described herein are designed to hold a bag of liquid with a volume in a range of about 3-6 gallons (though other ranges are contemplated) and/or a weight in a range of about 25-55 lbs. (though other ranges are contemplated). In some embodiments, such box assembly designs may utilize an outer shell formed of a top portion half-slotted container (HSC) and a bottom portion HSC, and an inner container (e.g., inner portion) stored therein that holds the bag, although embodiments of the present disclosure are not meant to be limited to such a box assembly design. In this regard, notably, embodiments of the present disclosure provide a box assembly design with various features (e.g., an outer shell) that are designed to aid in safe transport of the stored bag, while still providing for the conversion of the inner portion into a useful bag-in-box dispenser upon arrival at the final destination.

To achieve such a goal, some embodiments of the present disclosure provide a box assembly design with a top portion, a bottom portion, and an inner portion. One or more of the top, bottom, and inner portions may be corrugated in a different direction than the other portion(s) in order to provide increased strength in multiple directions. Such a configuration with strength characteristics in multiple orientations may be beneficial because the orientation of the box assembly during shipping is unknown and could be variable.

The inner portion includes a perforation feature defined by a series of perforations. In some embodiments, the perforation feature may extend across at least a portion of a front wall and/or a top front flap such that the perforation feature extends across a top edge of the formed box assembly. The perforation feature may be on a top, front, rear, side, and/or bottom of the inner portion. In some embodiments, the perforation feature may extend across a fold line between any of the top, front, side, rear, and/or bottom of the inner portion.

The perforation feature may include or be adjacent to a finger access feature for accessing the bag and its features inside the inner portion. The inner portion may further include a cut-out feature (e.g., pre-removed or perforated) in the front wall that is shaped to hold a dispensing tap (e.g., valve) of the bag once the inner portion is converted into a bag-in-box dispenser. In this regard, upon arrival at the final destination, a user may remove the top portion and/or the bottom portion, then the user may remove the perforation feature from the inner portion, reach in and arrange the dispensing tap into the cut-out feature, and rotate the entire box assembly 180° to, thus, convert the inner portion into the bag-in-box dispenser with the dispensing tap available for use. In some embodiments, the perforation feature may be located on a top, front, rear, side, and/or bottom panel of the inner portion, and thus, the rotation of the box assembly may only be 90°, for example.

Various additional features, such as a finger access portion, use of double-walled corrugate, rollover flaps, location of a glue joint (e.g., a side flange), direction of corrugation, among others described herein, are contemplated for some embodiments, and may aid in providing safe transport of the stored bag, while still providing for easy conversion of the inner portion into a useful bag-in-box dispenser upon arrival at the final destination.

In some embodiments, the inner portion, which is configured for conversion into a bag-in-box dispenser, may be cut from corrugated web with special themes, logos, instructions, and/or designs printed thereon. After forming the inner portion, products (e.g., bags of liquid) may be placed therein and flaps of the inner portion may be sealed (e.g., with clear tape) to, for example, contain and protect the products therein, as well as display any printing or designs thereon. In some embodiments, the inner portion may further include one or more interior features (e.g., shelves, insulation, etc.) designed to aid in the storage or dispensing of the bag. The inner portion may then be surrounded by and sealed within an outer shell formed by the top and bottom portions. The top and bottom portions may advantageously aid in the protection of the inner portion, and thus, the bag of liquid in order to provide the inner portion in a usable condition for conversion, use, and display of the bag-in-box dispenser at its final destination.

Corresponding systems and methods of manufacturing various example box assemblies are also provided herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 12:
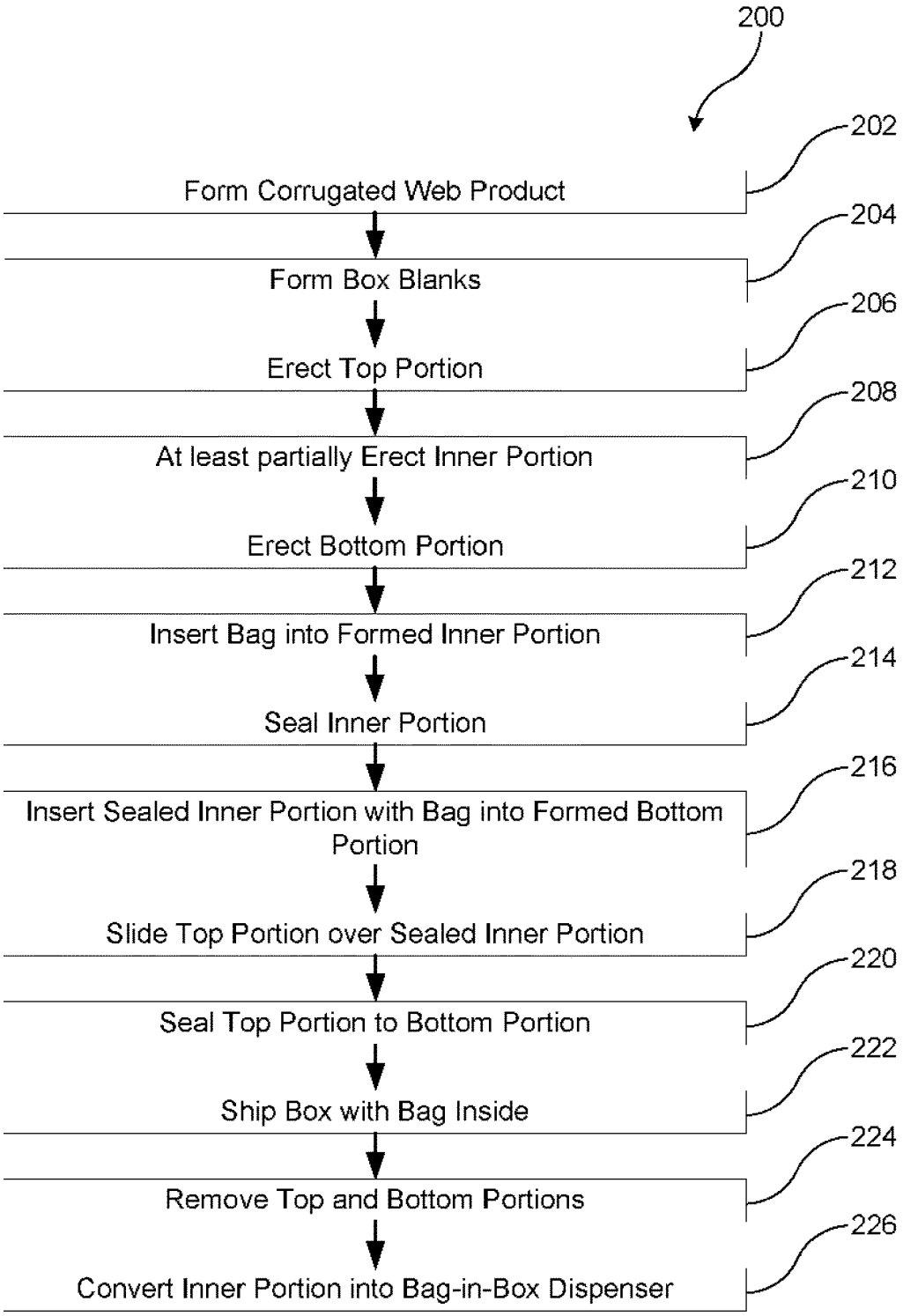
Figure 13:
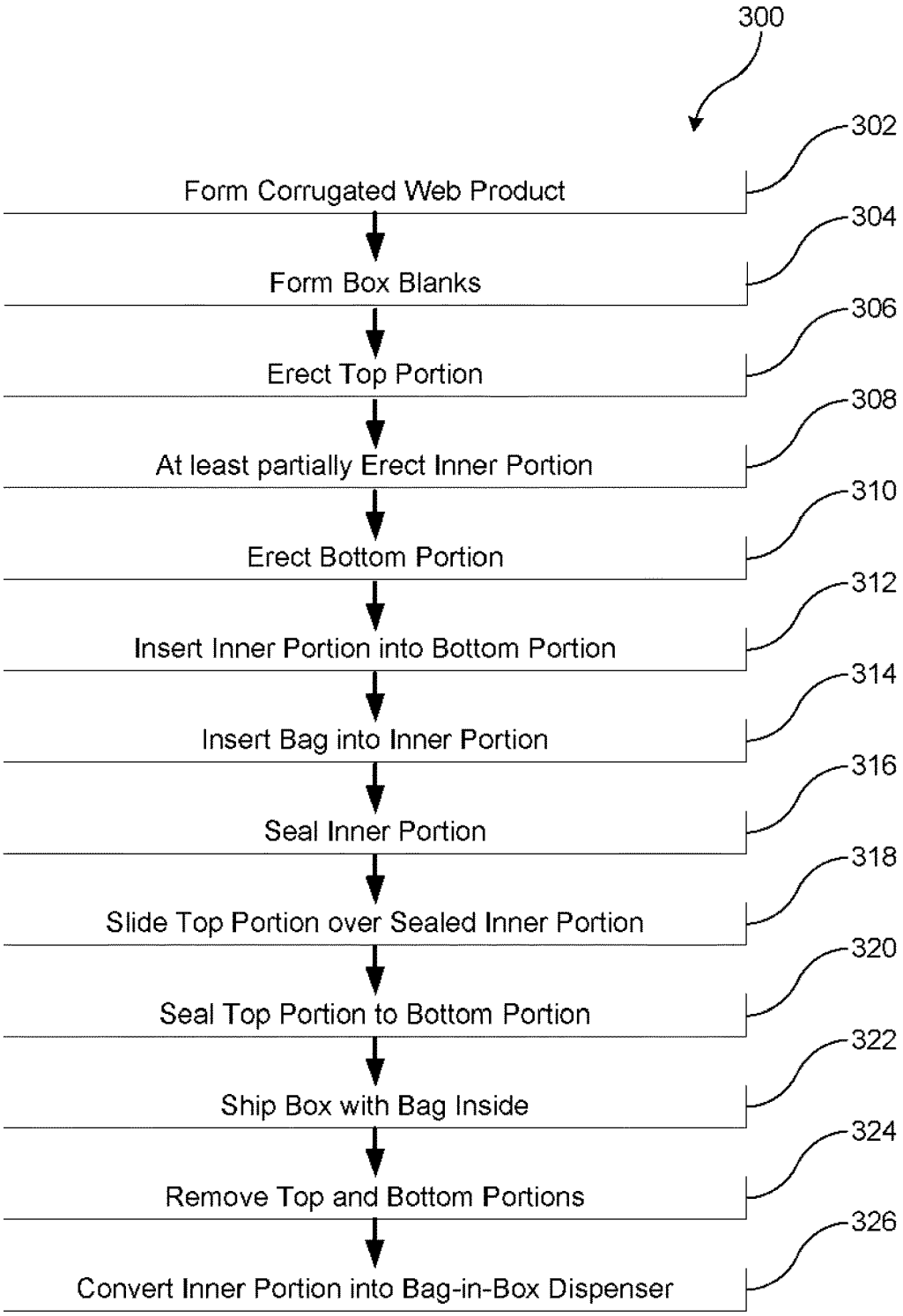

FIG. 12 illustrates a flowchart of an example method of forming a box assembly, shipping the box assembly with a bag stored therein, and converting the inner portion into a bag-in-box dispenser, in accordance with some embodiments discussed herein; and FIG. 13 illustrates a flowchart of another example method of forming a box assembly, shipping the box assembly with a bag stored therein, and converting the inner portion into a bag-in-box dispenser, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Rather, these example embodiments are provided so that this disclosure will satisfy applicable legal requirements. Like reference numerals refer to like elements throughout.

Notably, while some embodiments describe various positional qualifiers for various features, such as "top", "bottom", "front", "back", "side", etc., embodiments described herein are not meant to be limited to such qualifiers unless otherwise stated. Along these lines, and as an example, the "top"/"bottom" portion is also contemplated to be a "bottom"/"top" portion depending on the box assembly design/orientation or a "front" wall may be a "side" wall depending on the box assembly design/orientation. The directional qualifiers herein are generally used to aid in describing the disclosure in the context of the drawings and/or description but are not otherwise intended to be limiting.

While some embodiments describe a "user", use of such a term herein is not meant to be limited to a person or a single person, as the "user" may be an end user, a consumer, a manufacturer, among other types of users along a supply chain in relation to the box assembly design. Further, when utilizing the word "user", the actor(s) may be operating one or more machines/system that cause the intended function (e.g., forming or sealing the box assembly or converting the inner portion into a bag-in-box dispenser).

Various example embodiments of the present disclosure provide corrugated box assemblies for safely storing liquid products contained in bags within inner portions convertible to bag-in-box dispensers until arrival to their final destinations. Notably, some example corrugated box assemblies have high structural strength and are recyclable.

Various example embodiments of the present disclosure provide example box assembly designs for safe shipping of a heavy bag of liquid while still enabling conversion of an inner portion of the box assembly into a bag-in-box dispenser. For example, various box assembly designs described herein are designed to hold a bag of liquid with a volume in the range of about 3-6 gallons (though other ranges are contemplated) and/or a weight in the range of about 25-55 lbs. (though other ranges are contemplated).

Various example corrugated box assemblies provided herein are designed to hold liquid products, various cleaners and washing liquids, such as may be used to refill custodian spray bottles or other individual supplies (e.g., bottles). Other example liquids include wine, juice, or any type of liquid that would benefit a user to dispense. Along these lines the term "liquid" used herein may refer to any type of substance in liquid or semi-liquid state (e.g., fluid, creams, lotions, gels, water, aqueous solutions). In such a manner, an environmentally-friendly and relatively inexpensive box assembly is provided that allows an end user to dispense liquid products from a bag-in-box dispenser that has been protected during shipping.

In some embodiments, such box assembly designs may utilize a nesting design with multiple portions (e.g., a top, bottom, and inner portion). The inner portion may store the bag of liquid in a sealed interior and be convertible into a bag-in-box dispenser. The top and/or bottom portions may comprise an HSC and/or an HSC with rollover flaps, although embodiments of the present disclosure are not meant to be limited to such a box assembly design. The top and bottom portions may fit around the inner portion and be sealed to act as an outer protective shell for the convertible bag-in-box dispenser. Other example box assembly designs include regular slotted containers, wraparounds, overlapping slotted containers, die-cut containers, among others. Various embodiments described herein provide one or more features that alone or in combination with each other provide a suitable box assembly design for providing safe transport of the stored bag and inner portion, while still providing for easy conversion of the inner portion into a useful bag-in-box dispenser upon arrival at the final destination.

The multi-piece designs for the box assembly may allow for structural features and/or other enhancements. For example, at least one of the top, bottom, and inner portions may be corrugated in a different direction from the other portions (e.g., the top and bottom portions are corrugated in the horizontal direction, while the inner portion is corrugated in the vertical direction). The combination of multiple corrugation directions in the box assembly designs may provide increased strength (e.g., in both the horizontal and vertical directions), which may be useful for the withstanding the rigors of the shipping environment. For example, the disclosed box assembly designs may withstand stacking, dropping, and/or other external forces along any face or in any direction. This increased strength may be particularly useful in the individual e-commerce shipping environment.

Notably, example box assembly designs of the present disclosure are designed to withstand and pass various laboratory distribution tests that are specifically designed to replicate harsh conditions a box goes through during individual e-commerce shipping (e.g., through various known shipping services). Such example safety test standards include the International Safe Transit Association (ISTA) test standards which includes Ship In Own Container (SIOC) test standards, such as the ISTA Series 6-Amazon-.com-SIOC test protocol (e.g., the ISTA Series 6-Amazon-.com-SIOC test for 2018, with a version date with a last technical change in March 2018 and a last editorial change in March 2018—where further details are available at www.ista.org). Based on the packaging weight and/or girth, the box assembly may need to undergo an appropriate Type test (e.g., Type A for under 50 lbs. or Type B for over 50 lbs.). For example, the SIOC test standards require that the box assembly be packaged as planned to be shipped and be put through a testing protocol that includes numerous drops from various heights with the box assembly falling on different sides (e.g., walls, faces) and edges. This simulates possible drops that may occur during handling by shipping personnel. Next, the same box assembly undergoes vibration testing that includes prolonged vibration (e.g., for 2.5 hours, although other durations are contemplated) with weight placed on top of the box assembly—again at specified orientations (often required to be on the "weakest" face, such as an orientation in which the corrugated flutes for conventional box designs are not vertically oriented relative to the applied compression forces). This simulates travel within a transport vehicle (e.g., an airplane, train, truck, van, etc.) with other boxes or cargo being stacked on top of the box assembly. Finally, the same box assembly then goes through more drops from varying heights and on varying sides, corners, and/or edges, with one of the last drops being at a greater height and on the "weakest" side or edge. This once again simulates possible drops that may occur during handling by shipping personnel. Depending on the desired outcome, the box assembly may need to pass certain test criteria in order to comply with the standards. Notably, the ISTA Series 6-Amazon.com-SIOC test protocol acceptance criteria include that (i) the product is fully functional in its intended use, (ii) there are no leaks, (iii) any tamper-evident application is not compromised (e.g., seal integrity is intact), and (iv) any secondary packaging that is considered part of the product is free from serious damage/indentations/scratching.

The box assemblies disclosed may be designed to pass the ISTA Series 6-Amazon.com-SIOC test protocol or other shipping test protocol (e.g., to be able to ship using individual shipping options—such as the mail, truck delivery, etc.), while also maintaining certain form standards that enable the inner portion of the box assembly to be converted into the bag-in-box dispenser upon reaching its final destination. In this regard, the box assembly should survive (e.g., withstand) the entire test process while maintaining a desired form for the inner portion and the bag within the box assembly without any liquid spilling/leaking therefrom, such that the inner portion may be converted into a functioning bag-in-box dispenser as intended. In some embodiments, the box assembly may be considered to maintain a desired form even with some flexing, but without an undesirable degree of bulging, such as may include significant changes in the shape of the box assembly to limit its function. Such significant changes may include tearing or premature release of perforations on the inner portion, tearing or opening of flaps, failing or premature opening of adhesive joints, loss of the ability of the box assembly and/or inner portion to fit in a designated spot at the final destination (e.g., in a storage rack or storage position) or be suitable for stacking or supporting additional loads (e.g., on top of the box assembly and/or inner portion), preventing full evacuation of the liquid in the bag, and decreasing overall rigidity or integrity of the box assembly thereby hindering transportation or manipulation of the box assembly, for example. In such a regard, the resulting box assembly designs of the present disclosure are the product of significant testing, as many other designs were disregarded after failing such tests.

Figure 1:
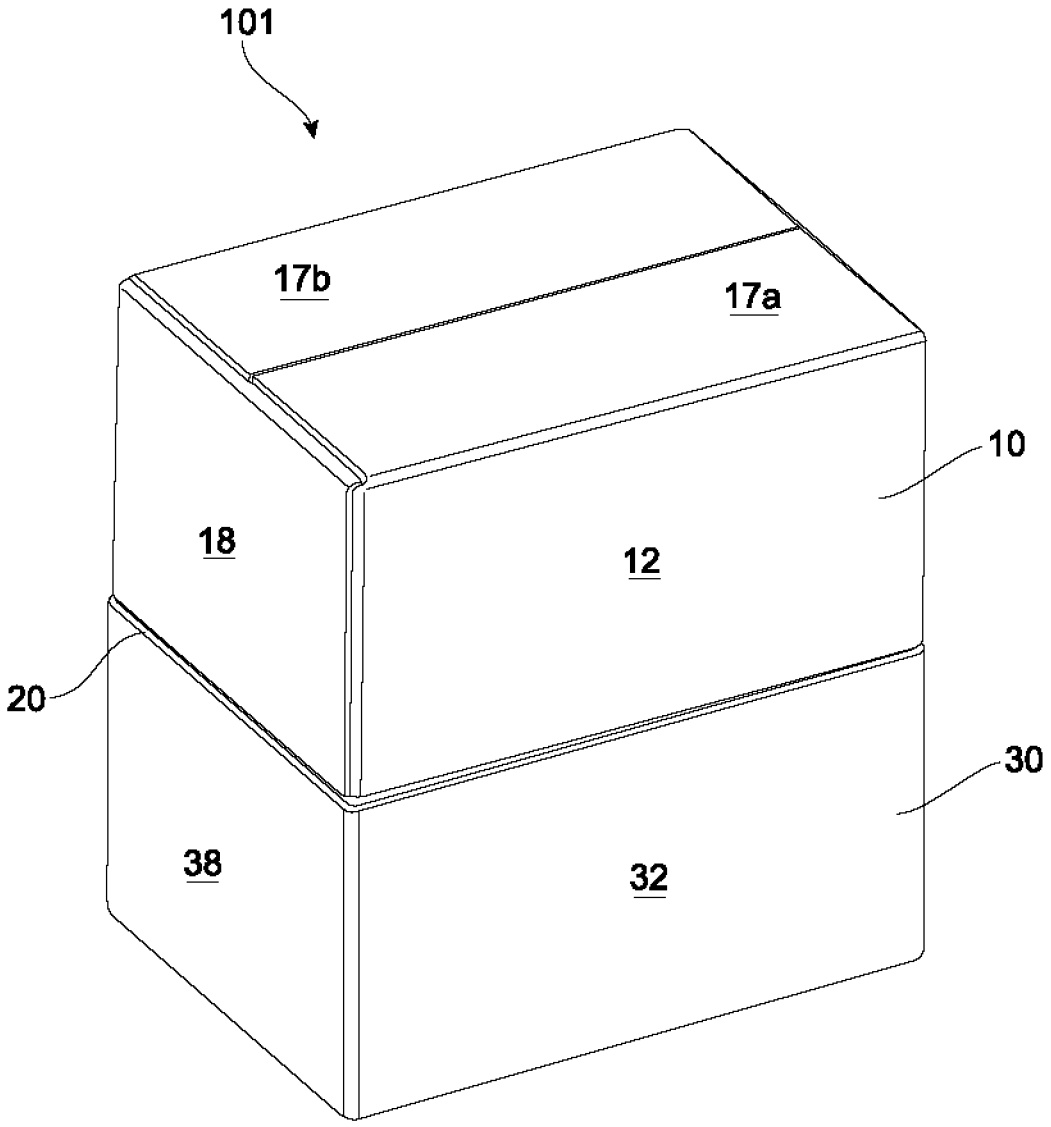
FIG. 1 is an illustration of a front-top-right isometric view of an example box assembly, in accordance with some embodiments discussed herein.

An example multi-piece corrugated box assembly 101 that accomplishes such advantages, including passing the above noted test standards, is shown in FIG. 1. With reference to FIGS. 1-6, the box assembly 101 is formed of a top portion 10, an inner portion 20, and a bottom portion 30.

As shown in FIG. 1, the top portion 10 and the bottom portion 30 may fit over and surround the inner portion 20. In this way, the top portion 10 and the bottom portion 30 may act as a protective outer shell around the inner portion 20. Thus, the box assembly 101 may be configured to withstand harsh shipping environments.

Figure 2:
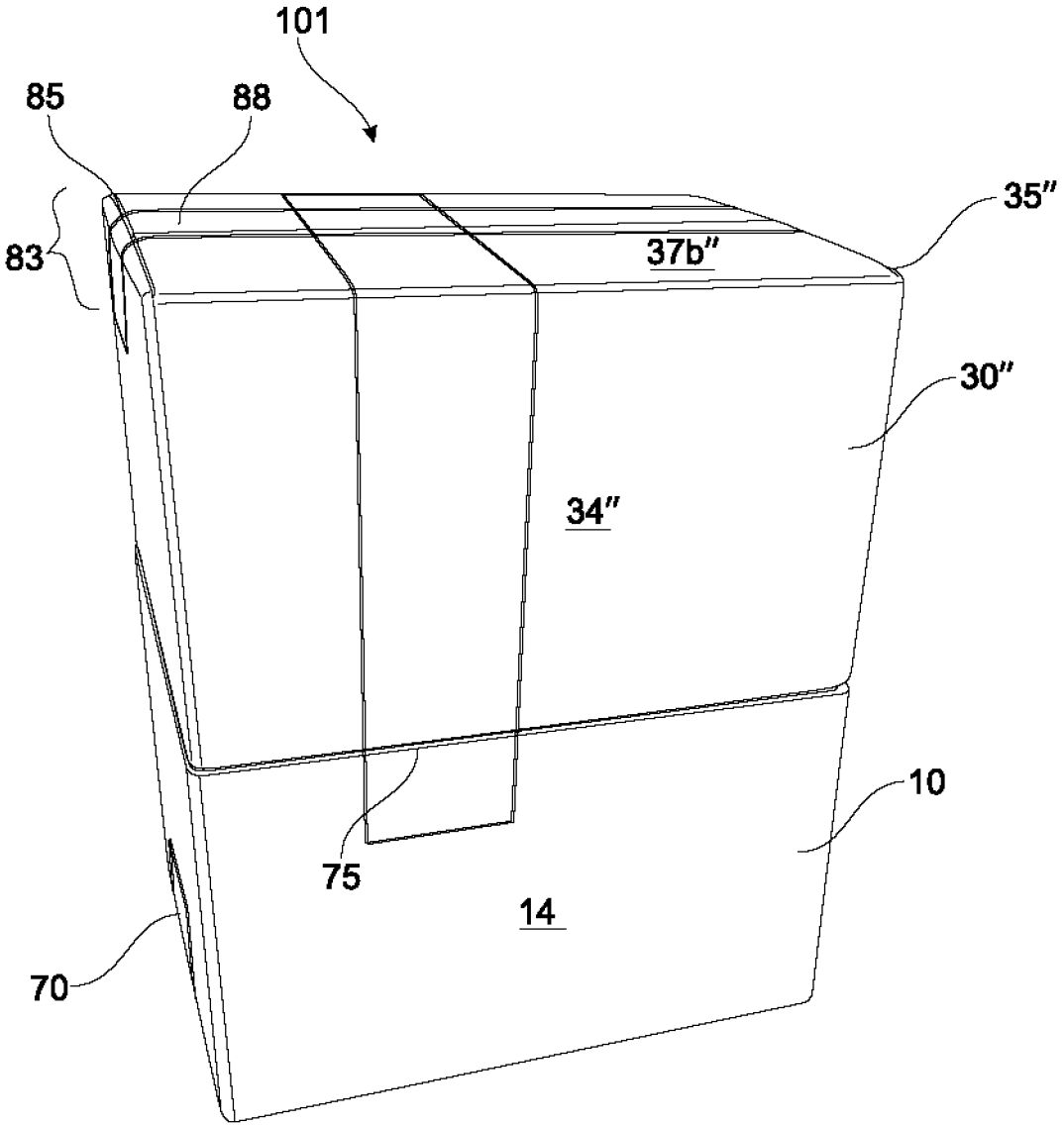
FIG. 2 is an image of a rear-bottom-left perspective view of an example box assembly with a top and bottom portion sealed around an inner portion, in accordance with some embodiments discussed herein.

As shown in FIG. 2, the top portion 10 may be sealed to the bottom portion 30 using tape 75. Additionally or alternatively, other sealing methods (e.g., adhesive, staples, etc.) may be utilized.

Figure 3:
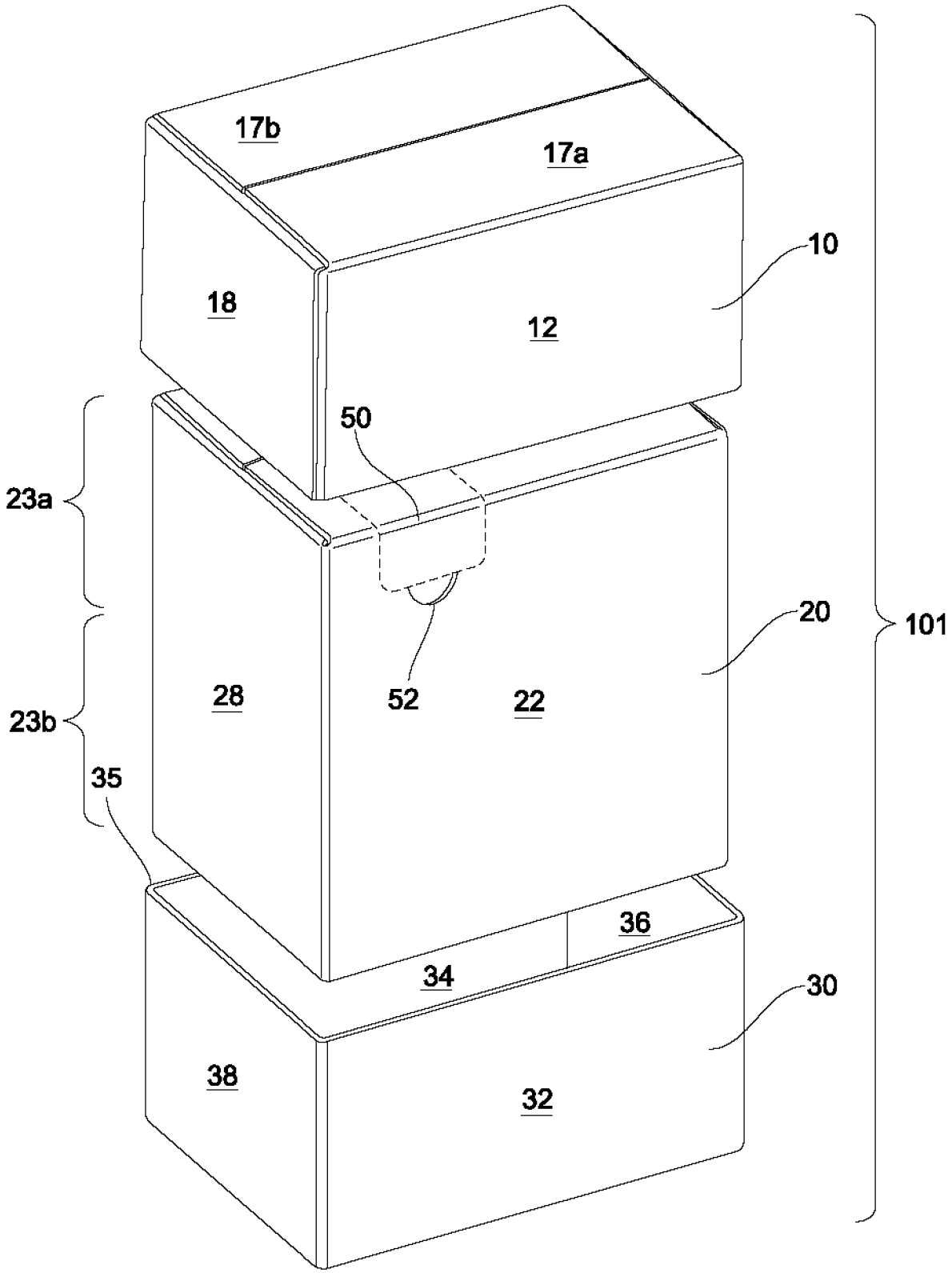
FIG. 3 is an illustration of a front-top-right isometric view of an example box assembly with a top, inner, and bottom portion separated, in accordance with some embodiments discussed herein.

As shown in FIG. 3, the top portion 10 and the bottom portion 30 may slide over the inner portion 20 to form the box assembly 101. Specifically, the top portion 10 may be sized to fit over a top inner portion part 23*a* of the inner portion 20, and the bottom portion 30 may be sized such that a bottom inner portion part 23*b* fits within the bottom portion 30. Although depicted as approximately equal halves of the inner portion 20, the top inner portion part 23*a* and bottom inner portion part 23*b* may be various complementary parts of the inner portion 20, and thus, the top portion 10 and the bottom portion 30 may be various complementary heights. In some embodiments, the top portion 10 may be identical to the bottom portion 30, which may save manufacturing costs.

Although shown and described in terms of a top inner portion part 23*a* and a bottom inner portion part 23*b*, the top inner portion part 23*a* may be a first inner portion part, and the bottom inner portion part 23*b* may be a second inner portion part. In some embodiments, the first inner portion part may be a top, bottom, front, rear, left, right, corner, and/or other part of the inner portion. Likewise, the second inner portion part may be a top, bottom, front, rear, left, right, corner, and/or other part of the inner portion. In some embodiments, the second part of the inner portion may be a remaining part of the inner portion, excluding the first part, such that the first and second parts make up the entire inner portion. In some embodiments, the first and second parts of the inner portion may be complementary. In some embodiments, the first and second parts of the inner portion may be unequally sized parts. In some embodiments, the first and second parts of the inner portion may be equal parts of the inner portion. In such embodiments where the first and second inner portion parts are equal, the first and second outer shell portions (e.g., top portion 10 and bottom portion 30) may be equal or identical, which may save on production costs.

Although shown and described in terms of a top and bottom portion, the top portion 10 and/or bottom portion 30 may be configured to be right, left, front, and/or rear portions with respect to the inner portion 20. Thus, the outer shell formed by the top and bottom portions may be configured in various alternative ways to cover and/or protect the convertible inner portion when sealed therein.

In some embodiments, the corrugation direction of the inner portion 20 may be different than (e.g., by about 90° from) the corrugation direction of the top portion 10 and/or bottom portion 30. For example, the inner portion 20 may be corrugated in the vertical direction, and the top portion 10 and the bottom portion 30 may be corrugated in the horizontal direction. In this way, the top portion 10 and the bottom portion 30 may protect the inner portion 20 from forces acting on the box assembly 101 in the horizontal direction, and the inner portion 20 may protect the bag of liquid 90 from forces acting on the box assembly 101 in the vertical direction. These corrugation directions may be reversed and varied. In this way, the disclosed box assemblies may improve upon, for example, conventional boxes that are designed with corrugation only in the vertical direction for providing the greatest strength in the vertical direction alone.

Figure 4:
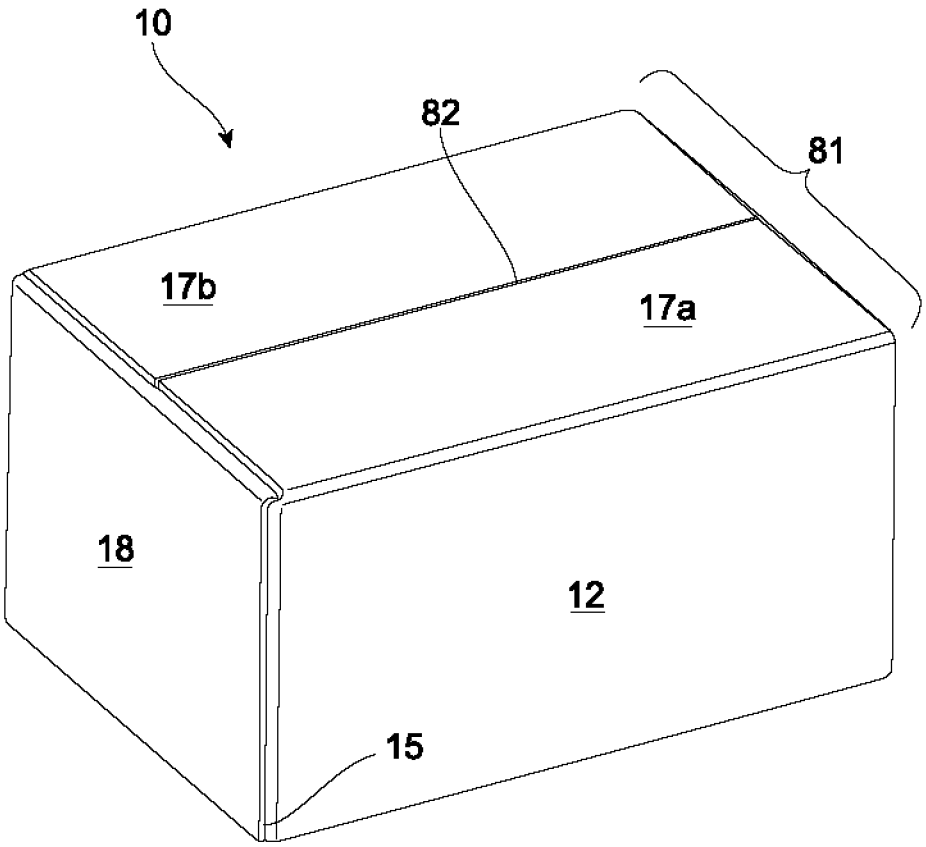
FIG. 4 is an illustration of a front-top-right isometric view of a top portion of the example box assembly shown in FIG. 3, in accordance with some embodiments discussed herein.
Figure 7:
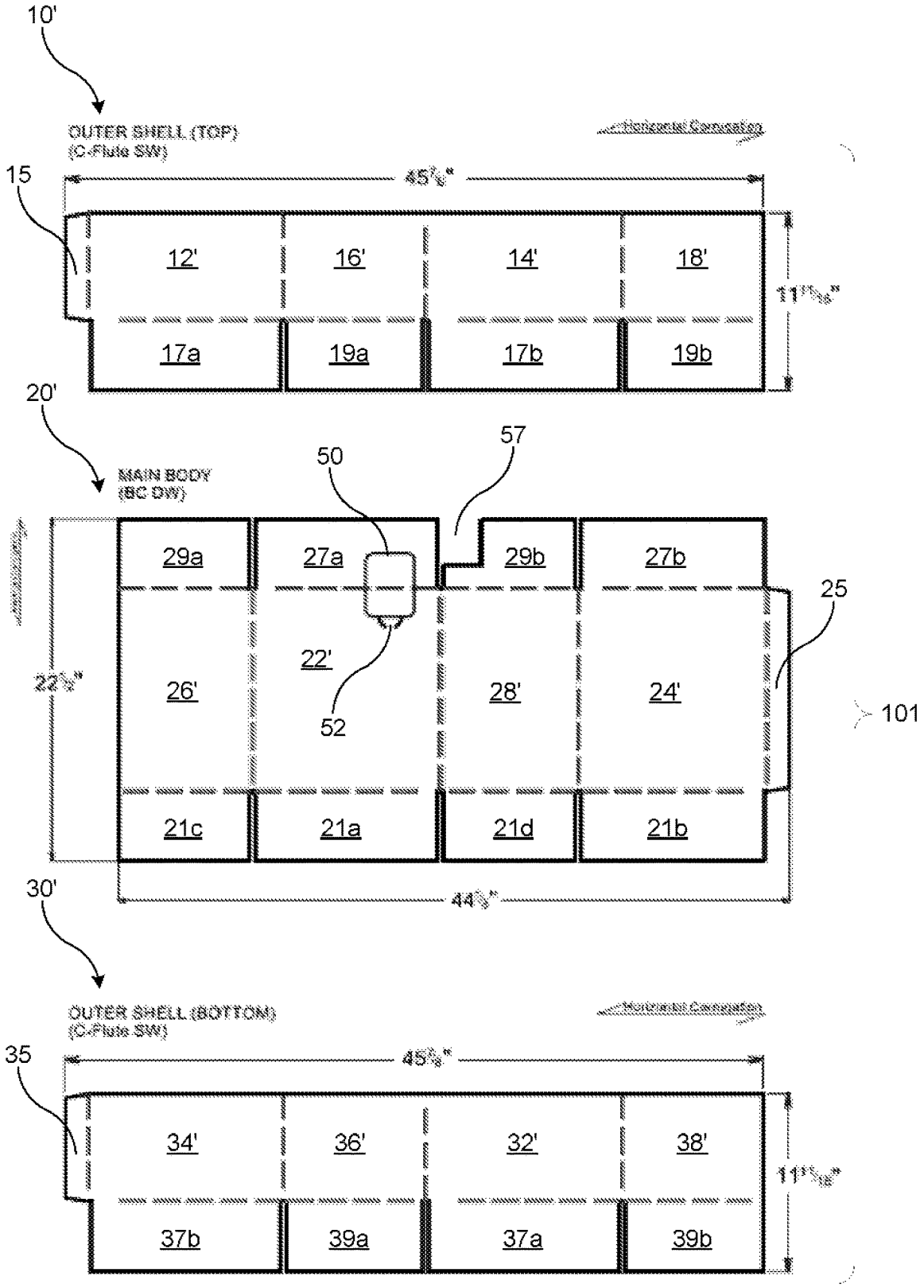
FIG. 7 illustrates a layout of blanks for the example box assembly shown in FIG. 3, in accordance with some embodiments discussed herein.

With reference to FIG. 4, the top portion 10 may comprise four walls: a front wall 12, a back wall 14, and two opposing side walls (e.g., first side wall 16 and second side wall 18). Corresponding panels (e.g., a front panel 12', back panel 14', a first side panel 16', and a second side panel 18') can be seen in the blank form of the top portion 10', as shown in FIG. 7. In this regard, the term "panels" may be used when in blank form and the term "walls" may be used when in the erected/formed box assembly form. As shown, the top portion 10 also includes a side flap 15 (notably, the side flap 15 may be attached to any suitable wall/panel depending on the desired box assembly design). To form the top portion 10 shown in FIG. 4, the side flap 15 may be attached, such as using adhesive (although additional or alternative attachment methods can be utilized, such as tape, staples, etc.), to the inside of the second side wall 18.

The top portion 10 (e.g., walls) may define an opening sized to fit around the top inner portion part 23*a* of the inner portion 20, as shown in the assembled and exploded views of FIGS. 1 and 3, respectively.

With further reference to FIG. 7, the top portion 10 may also include top flaps 17*a*, 17*b*, 19*a*, 19*b* that each extend from corresponding panels 12', 14', 16', 18'. In particular, a top front flap 17*a* extends downwardly from the front panel 12'; a top back flap 17*b* extends downwardly from the back panel 14'; a top first side flap 19*a* extends from the first side panel 16'; and a top second side flap 19*b* extends from the second side panel 18'. As shown in FIG. 4, the top flaps 17*a*, 17*b*, 17*c*, 17*d* of the top portion 10 fold (e.g., about 90°) from their corresponding walls to form a top 81. In this regard, the top first side flap 19*a* and the top second side flap 19*b* may fold underneath the top front flap 17*a* and the top back flap 17*b*, and the edges of the top front flap 17*a* and the top back flap 17*b* may meet together (or close together), forming a top flap gap 82. Although shown at a mid-point along a width of the top 81, the top flap gap 82 may be positioned anywhere along a width of the top 81 (e.g., closer to one side or the other). Likewise, the box assembly design may be formed to include overlapping top or bottom flaps. One or more pieces of tape 70 may extend across top flap gap 82 to form the top 81 (although additional or alternative attachment methods can be utilized, such as adhesive, staples, etc.).

Figure 5:
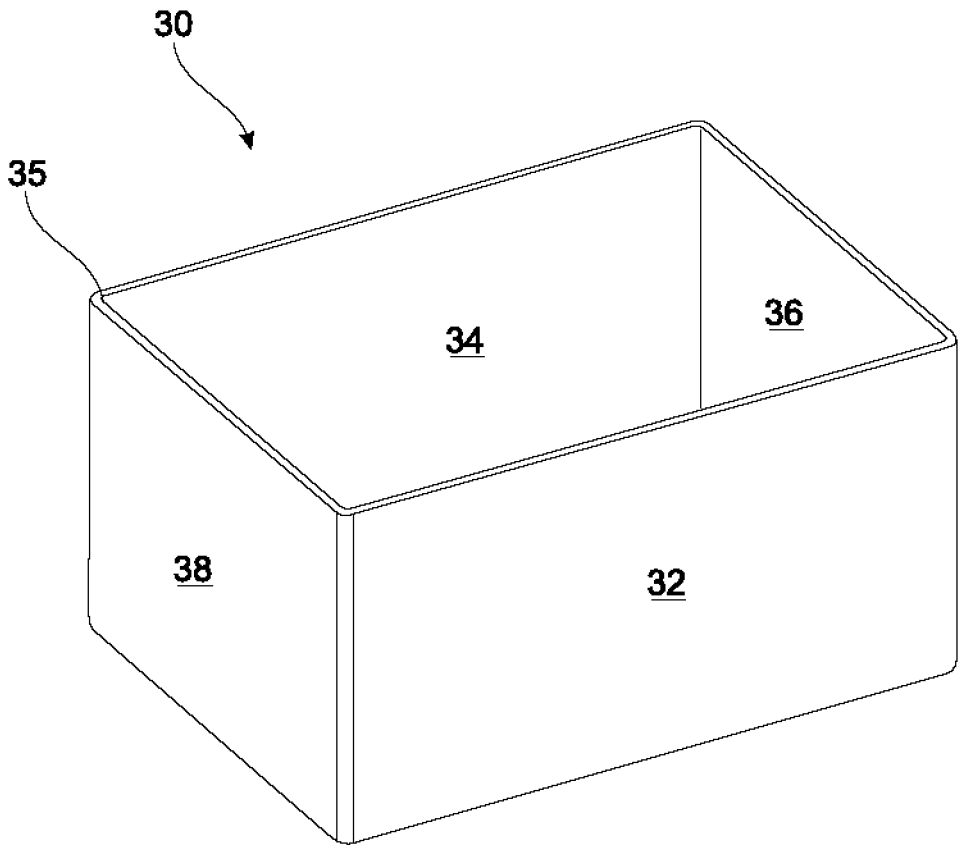
FIG. 5 is an illustration of a front-top-right isometric view of a bottom portion of the example box assembly shown in FIG. 3, in accordance with some embodiments discussed herein.

As shown in FIG. 5, the bottom portion 30 may comprise four walls: a front wall 32, a back wall 34, and two opposing side walls (e.g., first side wall 36, second side wall 38). Corresponding panels (e.g., a front panel 32', back panel 34', a first side panel 36', and a second side panel 38') can be seen in the blank form of the bottom portion 30', as shown in FIG. 7. As shown, the bottom portion 30 also includes a side flap 35 (notably, the side flap 35 may be attached to any suitable wall/panel depending on the desired box assembly design). To form the bottom portion 30 shown in FIG. 5, the side flap 35 may be attached, such as using adhesive (although additional or alternative attachment methods can be utilized, such as tape, staples, etc.), to the inside of the second side wall 38.

Figure 9:
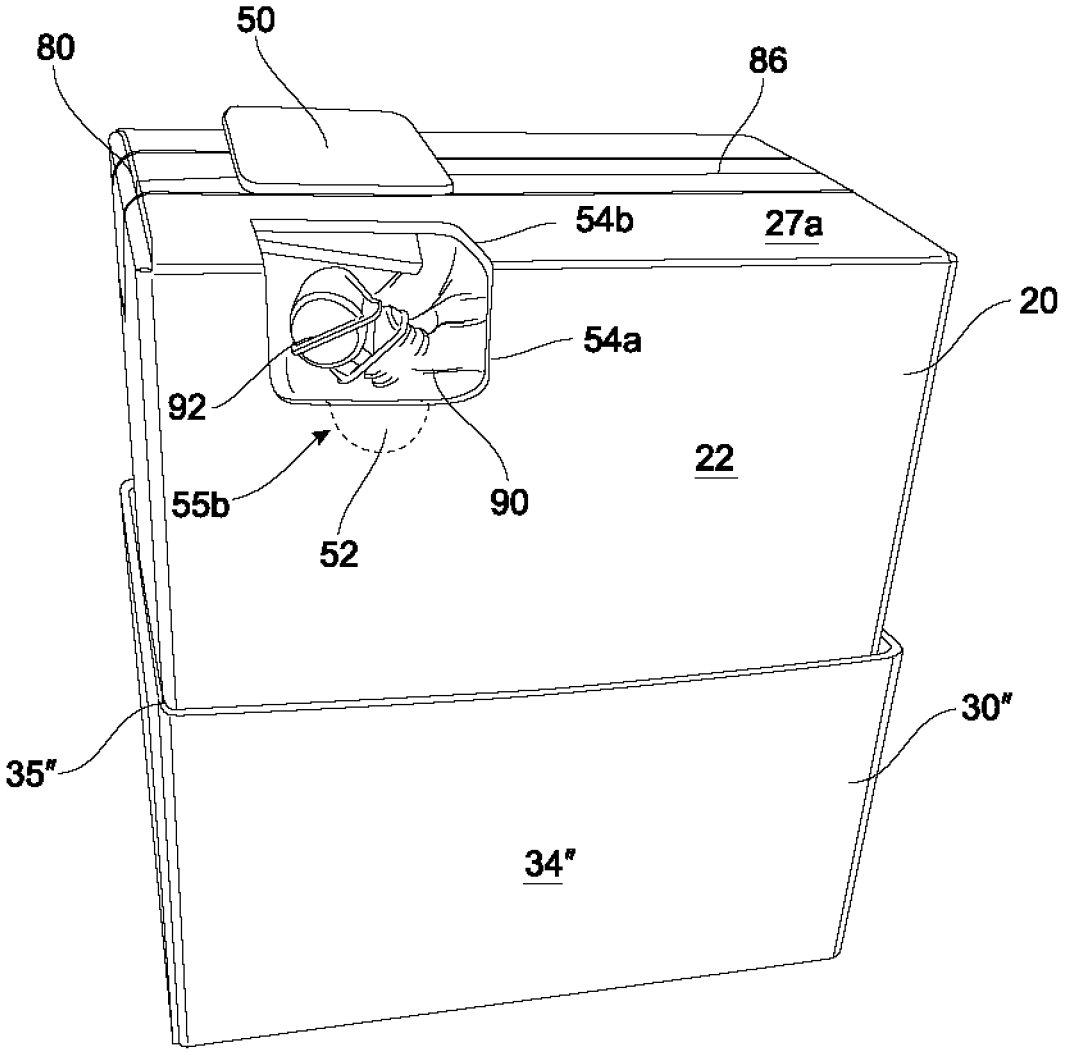
FIG. 9 is an image of a front-top perspective view of the example box assembly shown in FIG. 1, wherein the top portion and part of a perforation feature have been removed, in accordance with some embodiments discussed herein.
Figure 10:
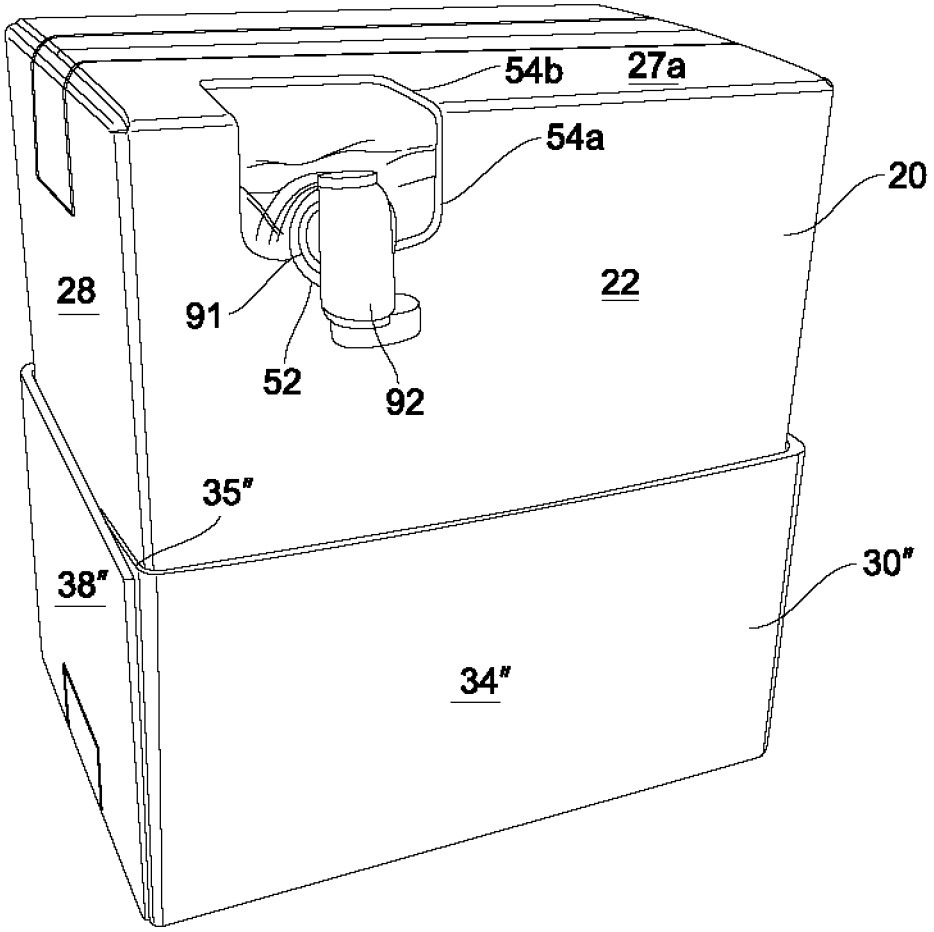
FIG. 10 is an image of a front-top-right perspective view of the example box assembly shown in FIG. 9 with the perforation feature completely removed, wherein a dispensing tap of a bag stored within the box assembly has been positioned into a dispensing position through the perforated region of the inner portion that was removed, in accordance with some embodiments discussed herein.

In some embodiments, the side flap 35 may be attached to the outside of the second side wall 38. Likewise, the blank form of bottom portion 30' may be folded in the opposite direction to form the bottom portion 30", as shown in FIGS. 2 and 9-10. The attachment position of the side flaps 15, 35 may be varied to optimize strength while balancing manufacturing costs. As shown in FIG. 3, the top portion 10 is identical to the bottom portion 30 in the positioning of the respective side flap 15, 35 such that both attachment positions of the side flaps (e.g., attachment corners) are positioned on the same second side of the box assembly 101 formed by the respective second side walls 18, 38. The top portion 10 and/or bottom portion 30 may be rotated such that the attachment corners are both adjacent the front/back of the box assembly 101. In some embodiments, the top portion 10 may not be identical to the bottom portion 30" (as shown in FIG. 2) such that, for example, the attachment corners may be located on diagonally opposite corners of the box assembly 101. Other configurations are possible, depending on the desired design. Thus, the top, inner, and bottom portion blanks (e.g., as shown in FIG. 7) may be folded in either direction to be formed into various configurations and locations for the side flaps 15, 25, 35.

The bottom portion 30 (e.g., walls) may define an opening sized to fit around the bottom inner portion part 23*b* of the inner portion 20, as shown in the assembled and exploded views of FIGS. 1 and 3, respectively.

With further reference to FIG. 7, the bottom portion 30 may also include bottom flaps 37*a*, 37*b*, 39*a*, 39*b* that each extend from corresponding panels 32', 34', 36', 38'. In particular, a bottom front flap 37*a* extends downwardly from the front panel 32'; a bottom back flap 37*b* extends downwardly from the back panel 34'; a bottom first side flap 39*a* extends downwardly from the first side panel 36'; and a bottom second side flap 39*b* extends downwardly from the second side panel 38'.

Returning to FIG. 2, which shows a bottom portion 30" in an upside-down orientation, the bottom flaps of the bottom portion 30 may fold from their corresponding walls to form a bottom 83. In this regard, the bottom first side flap 39*a* and the bottom second side flap 39*b* may fold underneath the bottom front flap 37*a* and the bottom back flap 37*b*, and the edges of the bottom front flap 37*a* and the bottom back flap 37*b* may meet together (or close together), forming a bottom flap gap 88. Although shown at a mid-point along a width of the bottom 83, the bottom flap gap 88 may be positioned anywhere along a width of the bottom 83 (e.g., closer to one side or the other). Likewise, the box assembly design may be formed to include overlapping top or bottom flaps. One or more pieces of tape 85 may extend across the bottom flap gap 88 to form the bottom 83 (although additional or alternative attachment methods can be utilized, such as adhesive, staples, etc.).

Although not shown, the top portion 10 and/or the bottom portion 30 may further include rollover flaps extending (e.g., upwardly) from corresponding panels (e.g., panels 32', 34', 36', 38' and/or panels 12', 14', 16', 18', as shown in FIG. 7). The rollover flaps may be folded inside the opening formed by the corresponding walls (e.g., panels 32, 34, 36, 38 and/or panels 12, 14, 16, 18) when the top portion 10 and/or bottom portion 30 is formed to provide extra rigidity (e.g., increased hoop strength) to the box assembly 101. In some embodiments, the edges formed by folding the rollover flaps may include one or more slots defined between continuous portions of the fold lines between the rollover flaps and corresponding walls. The slots may be configured to provide relative point(s) of weakness, such as to enable folding of the rollover flaps while still maintaining desired rigidity. In some embodiments, utilizing the slots may provide increased strength in some orientations.

As noted herein, the opening of the top portion 10 and the bottom portion 30 is sized to receive and contain the top inner portion part 23*a* and the bottom inner portion part 23*b*, respectively, as shown in FIGS. 1 and 3. Further, in some embodiments, such as depicted, the lengths of the walls of the top portion 10 and the bottom portion 30 correlate to the length of the walls of the inner portion 20 such that the bottom edges of the walls of the top portion 10 meet the top edges of walls of the bottom portion 30 (e.g., shown in FIG. 1) thereby each forming a standard half-slotted container.

Figure 6:
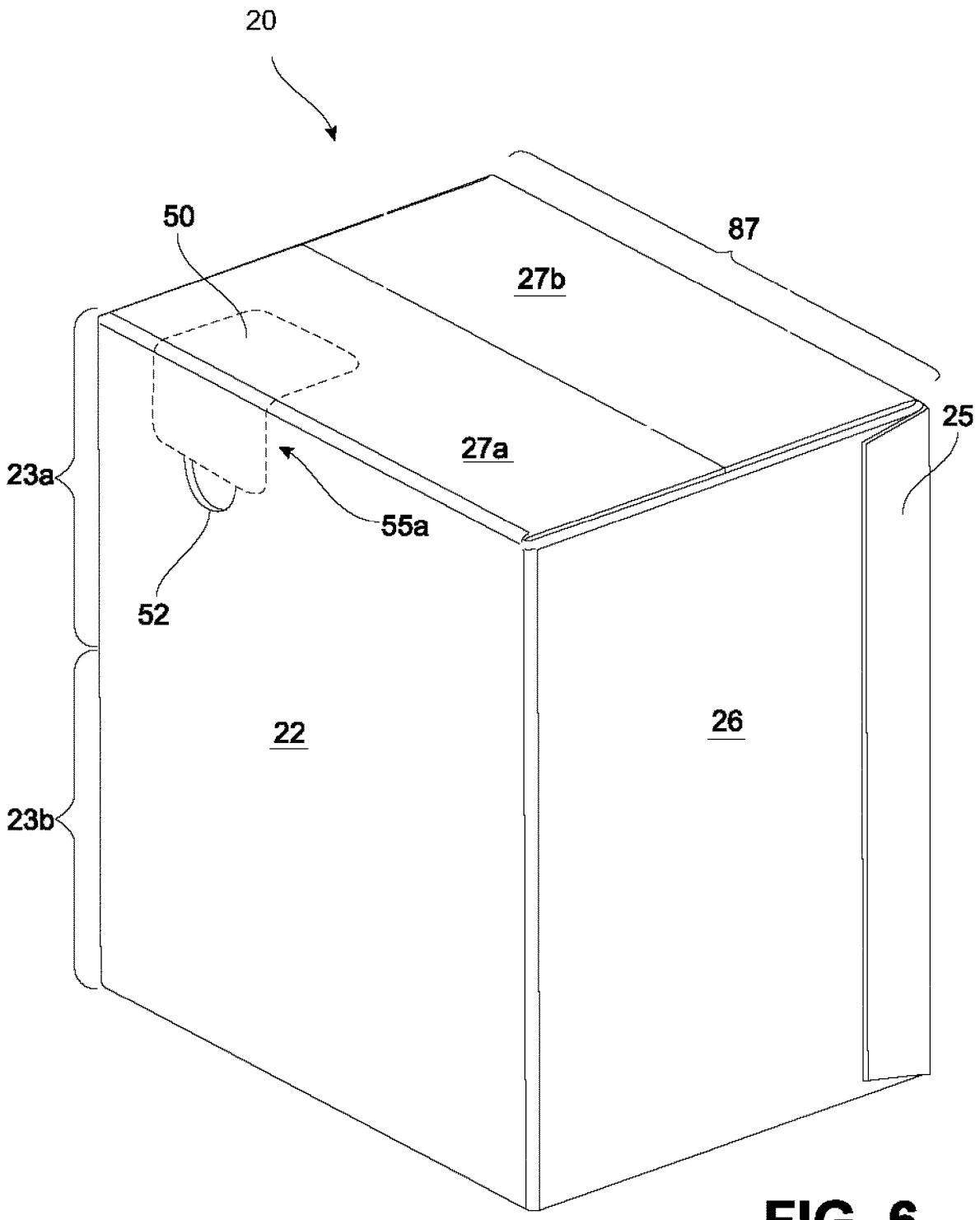
FIG. 6 is an illustration of a front-top-left isometric view of an inner portion of the example box assembly shown in FIG. 3, in accordance with some embodiments discussed herein.
Figure 11:
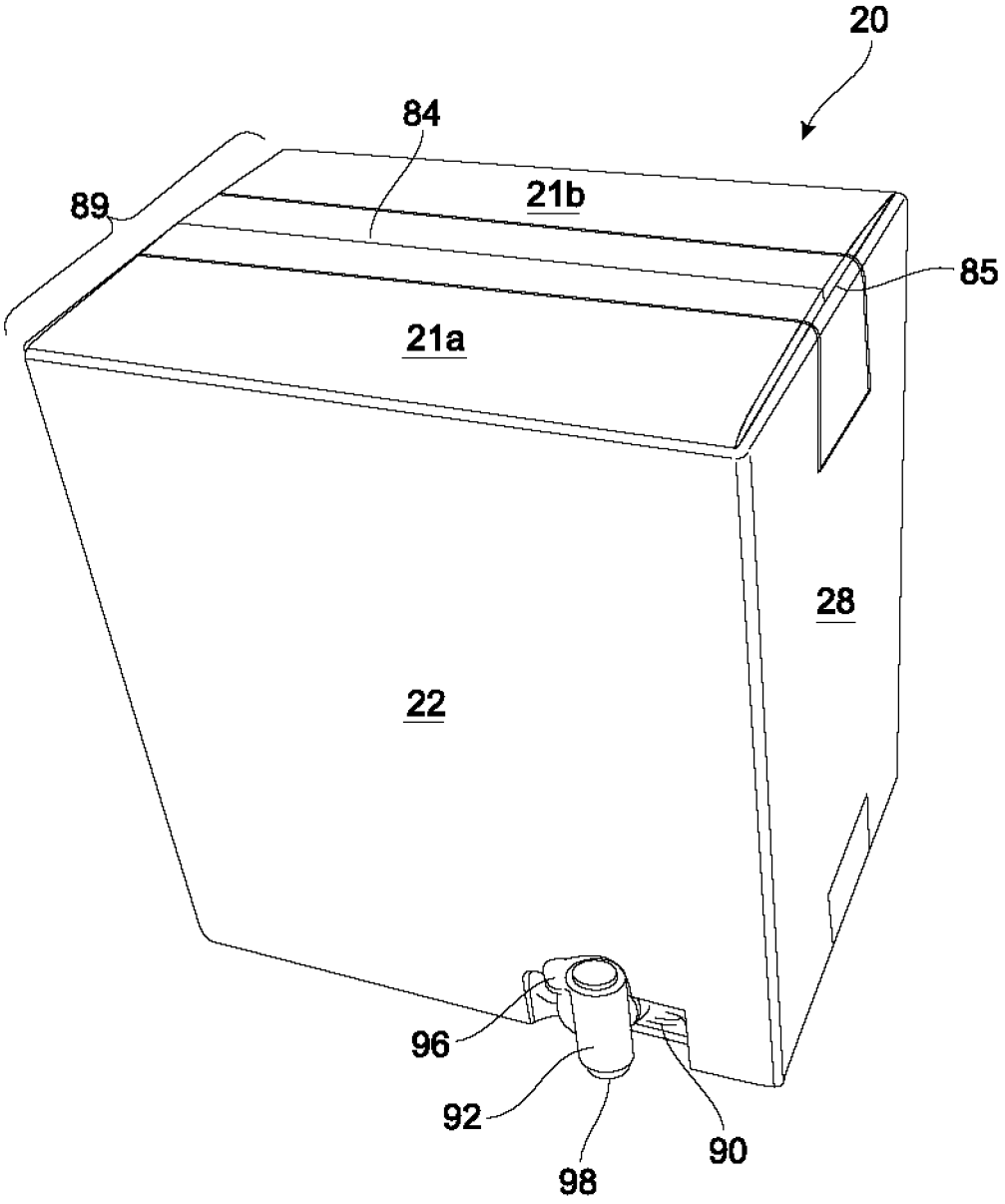
FIG. 11 is an image of a front-bottom-right perspective view of the example box assembly shown in FIG. 10, wherein the bottom portion has been removed and the inner portion has been moved (e.g., rotated) to a dispensing orientation, in accordance with some embodiments discussed herein.

As shown in FIGS. 6 and 11, the inner portion 20 may comprise four walls (e.g., faces): a front wall 22, a back wall 24, and two opposing side walls (e.g., first side wall 26, second side wall 28). Corresponding panels (e.g., a front panel 22', back panel 24', a first side panel 26', and a second side panel 28') can be seen in the blank form of the inner portion 20' shown in FIG. 7. As shown in FIG. 7, the inner portion 20 also includes a side flap 25 (notably, the side flap 25 may be attached to any suitable wall/panel depending on the desired box assembly design). To form the inner portion 20 shown in FIG. 6, the side flap 25 may be attached, such as using adhesive (although additional or alternative attachment methods can be utilized, such as tape, staples, etc.), to the first side wall 26. When formed, the inner portion 20 defines an interior for receiving and storing a bag, such as a bag of liquid 90. The bag of liquid 90 may have a volume in the range of about 3-6 gallons, for example. Notably, by attaching the side flap 25 to an outside surface of one of the walls, the side flap 25 (which may contain a rough corrugated and/or relatively sharp edge) is separated from the stored bag held within the interior of the inner portion 20 so as to avoid damage to the stored bag during shipping.

As shown in FIG. 7, the inner portion 20 may include bottom flaps 21*a*, 21*b*, 21*c*, 21*d* that each extend from corresponding panels 22', 24', 26', 28'. In particular, a bottom front flap 21*a* extends downwardly from the front panel 22'; a bottom back flap 21*b* extends downwardly from the back panel 24'; a bottom first side flap 21*c* extends downwardly from the first side panel 26'; and a bottom second side flap 21*d* extends downwardly from the second side panel 28'. The bottom flaps 21*a*, 21*b*, 21*c*, 21*d* may be folded (e.g., about 90°) with respect to their corresponding walls to form an inner bottom 89 (e.g., as shown in FIG. 11 in which the inner portion 20 is in an upside-down orientation). In this regard (and with reference to the inner portion 20 in an upside-down orientation), the bottom first side flap 21*c* and the bottom second side flap 21*d* may fold underneath the bottom front flap 21*a* and the bottom back flap 21*b*, and the edges of the bottom front flap 21*a* and the bottom back flap 21*b* may meet together or close together, forming an inner bottom flap gap 84. Although shown at a mid-point along a width of the inner bottom 89, the inner bottom flap gap 84 may be positioned anywhere along a width of the inner bottom 89 (e.g., closer to one side or the other). As shown in FIG. 11, one or more pieces of tape 85 may extend across the inner bottom flap gap 84 to form the inner bottom 89 (although additional or alternative attachment methods can be utilized, such as adhesive, staples, etc. to otherwise secure the flaps). After the inner bottom 89 is formed and sealed, the walls and inner bottom 89 of the inner portion 20 may together form the interior configured for receiving and storing the bag of liquid 90.

With further reference to FIG. 7, the inner portion 20 also includes top flaps 27*a*, 27*b*, 29*a*, 29*b* that each extend from corresponding panels 22', 24', 26', 28', respectively. In particular, a top front flap 27*a* extends upwardly from the front panel 22'; a top back flap 27*b* extends upwardly from the back panel 24'; a top first side flap 29*a* extends upwardly from the first side panel 26'; and a top second side flap 29*b* extends upwardly from the second side panel 28'. As shown in FIG. 6, the top flaps of the inner portion 20 fold from their corresponding walls to form an inner top 87. In this regard, the top first side flap 29*a* and the top second side flap 29*b* may fold underneath the top front flap 27*a* and the top back flap 27*b*, and the edges of the top front flap 27*a* and the top back flap 27*b* may meet together or close together, forming an inner top flap gap 86 (shown in FIG. 9). Although shown at a mid-point along a width of the inner top 87, the inner top flap gap 86 may be positioned anywhere along a width of the inner top 87 (e.g., closer to one side or the other). Likewise, the box assembly design may be formed to include overlapping top or bottom flaps.

When the inner portion 20 is being erected, the inner bottom 89 may be formed and sealed, and the inner top 87 may be left open until a bag of liquid 90 is inserted into the interior of the inner portion 20. Once the bag of liquid 90 is arranged appropriately inside the interior of the inner portion 20, the top flaps 27*a*, 27*b*, 29*a*, 29*b* may be folded to form the inner top 87, and the inner top 87 may be sealed to secure the bag of liquid 90 in the inner portion 20. As shown in FIG. 9, one or more pieces of tape 80 may extend across the inner top flap gap 86 to form the inner top 87 (although additional or alternative attachment methods can be utilized, such as adhesive, staples, etc. to otherwise secure the flaps).

With reference to FIG. 6, the inner portion 20 of the box assembly 101 may be designed with a perforation feature 50. The perforation feature may be defined by a series of perforations 55*a* (e.g., weak points) that help a user with removal thereof, such that the perforation feature is removable from a remainder of the inner portion 20. With reference to FIGS. 6-7, the perforation feature 50 may be defined on the front wall 22/front panel 22' and the top front flap 27*a* of the inner portion 20, 20'.

Although the perforation feature 50 is shown and described with respect to the front wall/panel and top front flap, in some embodiments, the perforation feature may be located on other walls/panels and/or flaps (including multiple walls/panels and flaps). For example, the perforation feature 50 may be on the inner top 87 (e.g., top front flap 27*a*, top back flap 27*b*), the inner bottom 89 (e.g., bottom front flap 21*a*, bottom back flap 21*b*), the front wall 22, the back wall 24, and/or side (e.g., first side wall 26, second side wall 28) of the inner portion 20. In some embodiments, the perforation feature 50 may extend across a fold line between any of the inner top 87 (e.g., top front flap 27*a*, top back flap 27*b*), the inner bottom 89 (e.g., bottom front flap 21*a*, bottom back flap 21*b*), the front wall 22, the back wall 24, and/or side (e.g., first side wall 26, second side wall 28) of the inner portion 20.

Thus, because the top portion 10 and/or bottom portion 30 may be configured to be right, left, front, and/or rear portions with respect to the inner portion 20, there are many configurations possible for the inner portion 20 and outer shell portions (e.g., top portion 10 and bottom portion 30). For example, in some embodiments, the perforation feature 50 may extend across a fold line between the back wall 24 and the second side wall 28, the top portion 10 may fit around the second side wall 28 and left portion of the inner portion 20, and the bottom portion 30 may fit around the first side wall 26 and the right portion of the inner portion 20. In such embodiments, the top portion 10 may be removed, followed by the perforation feature 50 and optionally the bottom portion 30, then the inner portion 20 may be rotated 90° and converted into a bag-in-box dispenser.

As detailed further herein, the perforation feature 50 is removable to help convert the inner portion 20 into a bag-in-box dispenser, such as shown in FIG. 11. In this regard, a benefit of the perforation feature 50 is that it facilitates removal of a portion of the inner portion 20 to allow a user to access a dispensing tap (e.g., valve, opening, nozzle, etc.) on the bag of liquid 90 that is held within the inner portion 20 and enable repositioning of the dispensing tap to a dispensing position (e.g., at least partially extending outside of the inner portion 20 and, thus, accessible by a user for dispensing the liquid product from the bag 90).

In the illustrated embodiment, the perforation feature 50 extends across the front wall 22 and the top front flap 27*a* such that removal of the perforation feature 50 removes a portion 54*a* of the front wall 22 that is adjacent and continuous with a portion 54*b* of the top front flap 27*a* that is also removed. For example, the perforation feature 50 extends across a fold line between the front panel 22' and the top front flap 27*a*. With reference to FIGS. 9-10, by removing a continuous portion (e.g., both the portion 54*a* and the portion 54*b*), a user may access the dispensing tap 92 that is stored with the bag of liquid 90 inside the interior of the inner portion 20 and reposition the dispensing tap 92 to extend out through the front wall 22. In such a regard, with reference to FIG. 10, the perforation feature 50 defines a portion 54*a* of the front wall 22 that is sized to enable a dispensing tap 92 of a stored bag of liquid 90 to extend at least partially through and/or past the front wall 22 when the inner portion 20 is converted into the bag-in-box dispenser. Of further note, with reference to FIG. 11, a benefit to positioning the perforation feature 50 along a top edge of the front wall 22 is that when the inner portion 20 is converted into the bag-in-box dispenser by rotating it (e.g., 180°), the dispensing tap 92 is positioned at a bottom of the bag of liquid 90 to facilitate removal of the liquid contents of the bag with the aid of gravity.

Returning to FIG. 6, the inner portion 20 may further define a finger access feature 52 (further shown in FIG. 9) positioned adjacent to the perforation feature 50. The finger access feature 52 may be at least partially defined by a series of perforations 55*b* (e.g., a separate but adjacent series of perforations than the perforation feature) and may be removable separately from the perforation feature 50 to enable easier access for a user to remove the perforation feature 50, as shown in FIG. 9. Though the finger access feature 52 is shown defined on the front wall 22, in various embodiments, the finger access feature 52 may be formed on one or more walls or top flaps. Along similar lines, though the finger access feature 52 is shown as a semi-circle, any shape may be used. In some embodiments, as shown in FIG. 6, the finger access feature 52 may be pre-removed from the inner portion 20.

Although not shown, in some embodiments, the inner portion 20 may further define a cut-out or other feature that is configured to enable the dispensing tap 92 to extend past or through the front wall 22 when the inner portion 20 is converted into the bag-in-box dispenser. The cut-out feature may define a shape (e.g., a semi-circle, although other shapes are contemplated) that corresponds to a portion 91 of the dispensing tap 92 such that the cut-out feature at least partially holds the dispensing tap 92 in position when inner portion 20 is converted into the bag-in-box dispenser. Although shown and described as being pre-removed, in some embodiments, the cut-out feature may be removable such as by using a series of perforations—similar to the perforation feature 50 described herein.

In some embodiments, the inner portion 20 may be configured to enable easy removal of the perforation feature 50 and provide space for a user to access the dispensing tap 92 of a stored bag of liquid 90 upon removal of the perforation feature 50. In such a regard, in some embodiments, a top flap of the inner portion 20 may define a modified shape (e.g., modified from a normal footprint, such as defined by its opposing top flap). For example, a portion of a top flap may be cut out (e.g., removed) and/or formed according to the modified shape. For example, with reference to FIG. 7, the top second side flap 29*b* (which extends from the second side wall 28 of the inner portion 20) defines a cut-out feature 57. The cut-out feature 57 may be an area cut-out from the normal rectangular footprint of the top second side flap 29*b* (e.g., in some embodiments the top flap may define a corresponding modified shape (e.g., modified from a normal footprint of the top flap)—for example, in such a regard, there need not be a cut-out that occurs as the top flap could simply be formed with the modified shape). The cut-out feature 57 may be positioned on the top second side flap 29*b* to align with the portion 54*b* of the perforation feature 50 on the front top flap 27*a* when the inner portion 20 is formed (e.g., shown in FIG. 9) so as to enable a user to access a dispensing tap 92 of the stored bag of liquid 90 within the interior of the inner portion 20 upon removal of the perforation feature 50.

In some embodiments, the box assembly 101 (or portions thereof) may be formed of double-walled corrugate to add strength to the box assembly 101, such as may be beneficial for individual box shipping and/or passing the test standards noted herein. In some embodiments, both the top portion 10 and the bottom portion 30 are formed of double-walled corrugate. In some embodiments, the box assembly 101 (or portions thereof) may be formed of additional layers of corrugate (e.g., triple-walled corrugate, or more), such as may be beneficial for further increased strength. In some embodiments, the box assembly 101 (or portions thereof) may be formed of other types of material, such as cartonboard, microflute corrugate, etc.

Figure 8:
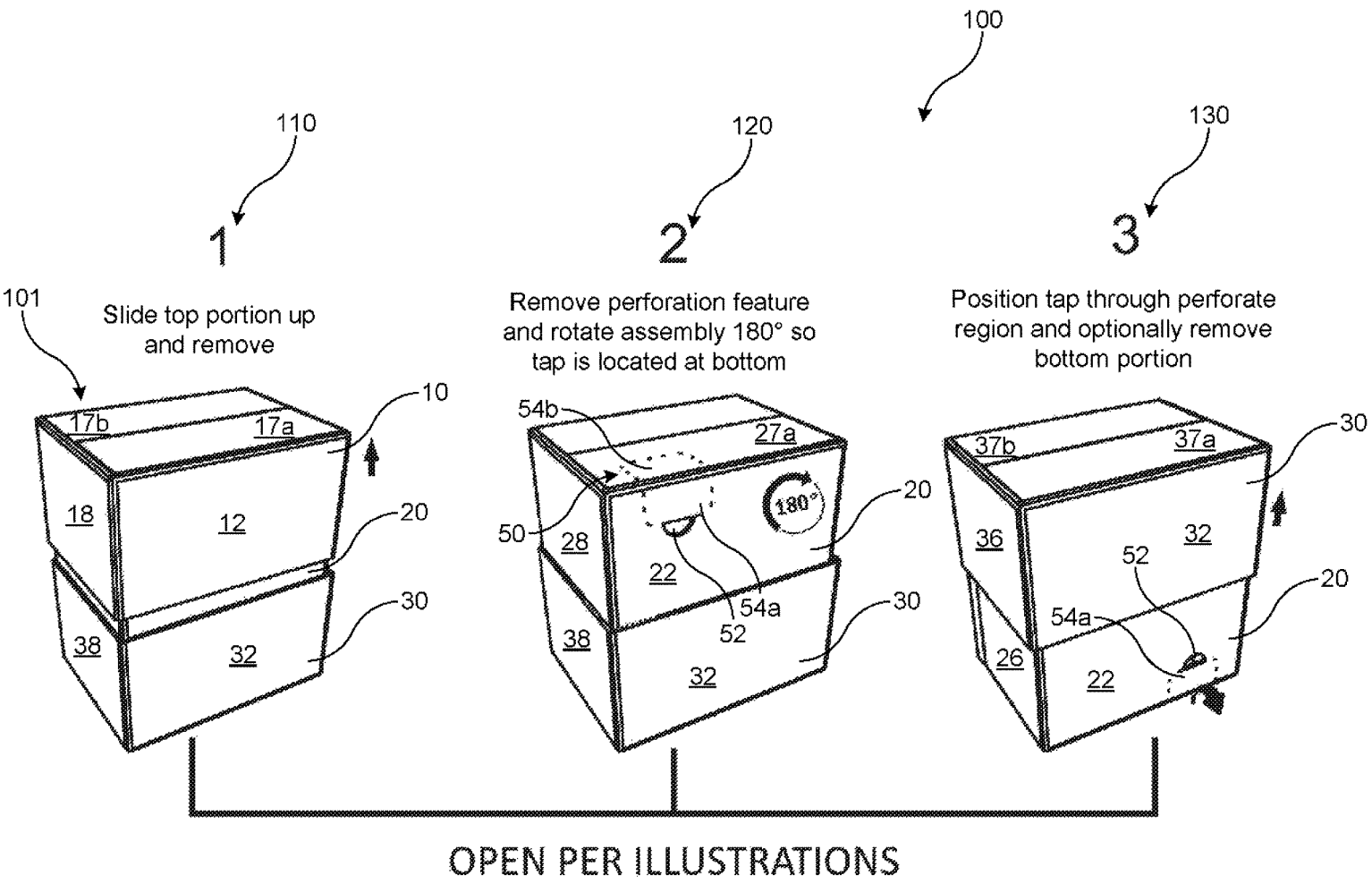
FIG. 8 illustrates an example method of converting the inner portion of an example box assembly into a bag-in-box dispenser, in accordance with some embodiments discussed herein.

FIG. 8 illustrates an example process an end user may use to convert the box assembly 101 into a bag-in-box dispenser. First, after detaching the top portion 10 from the bottom portion 30, the user may remove the top portion 10 from off of the inner portion 20 by sliding the top portion 10 upwardly (e.g., step 110). Next, the user may rotate the remaining inner portion 20 and bottom portion 30 of the box assembly 101 180° such that the inner portion 20 is in an upside-down orientation (e.g., step 120). Before or after rotating, the user may remove the perforation feature 50, such as by using the finger access portion 52, such as by inserting their finger into the finger access portion 52 and pulling the finger access portion 52 and the perforation feature 50 (e.g., step 130). The user may optionally remove the bottom portion 30 from the remaining inner portion 20.

With reference to FIG. 9, removal of the perforation feature 50 provides access to the dispensing tap 92 of the stored bag of liquid 90. With both portions 54*a*, 54*b* of the perforation feature 50 removed, a user can reach in and pull the dispensing tap 92 out and position it within the cut-out feature, if present, (e.g., depicted in completed form in FIG. 10) to position the dispensing tap 92 in a dispensing position. Notably, the dispensing tap 92 may face upwardly if the perforation feature 50 is removed before flipping. In flipping (e.g., rotating) the remaining inner portion 20 and bottom portion 30 of the box assembly 101 over such that the dispensing tap 92 is at the bottom of the bag of liquid 90 (e.g., depicted in completed form in FIG. 11), the inner portion 20 (which is now converted into a bag-in-box dispenser) is placed in a dispensing orientation. The dispensing orientation may enable a user to activate dispensing of the liquid product from the bag 90 using one or more dispensing features 96 (e.g., a lever for opening flow through the dispensing tap 92), as shown in FIG. 11. Accordingly, the liquid within the bag 90 may flow through an outlet 98. Notably, the outlet 98 of the dispensing tap 92 is positioned below the bottom of bag of liquid 90 in the dispensing orientation to encourage full dispensing from the bag 90 via gravity.

Although the depicted embodiment utilizes a dispensing tap with a lever, other types of dispensing taps are contemplated (e.g., valves, openings, nozzles, etc.).

Of further note, the entire process may be completed without the end user having to remove the bottom portion 30 from the inner portion 20 and may only require one flip of the box assembly 101, which may be beneficial for easy handling and keeping the heavy bag of liquid 90 within the inner portion 20 and intact.

In some embodiments, the user may at least partially remove the bottom portion 30 to aid in converting the inner portion 20 into the bag-in-box dispenser. For example, the user may discard the bottom portion 30 or use the bottom portion 30 to lift the inner portion 20 higher off a table or support for easier dispensing. In some embodiments, the top portion 10 and/or bottom portion 30 may be converted into additional parts (e.g., lift, support) for aiding in the dispensing of the liquid product from the converted bag-in-box dispenser (e.g., the formerly intact inner portion 20).

Example Flowchart(s)

Embodiments of the present disclosure provide methods and systems for forming a box assembly, shipping the box assembly with a bag stored therein, and converting an inner portion of the box assembly into a bag-in-box dispenser, according to various embodiments described herein. In this regard, associated systems and methods for manufacturing, shipping, forming example box assembly designs, and converting inner portions into corresponding bag-in-box dispensers described herein are contemplated by some embodiments of the present disclosure. Such systems and methods may include various machines and devices, including for example box forming devices (e.g., for folding, gluing, and/or taping boxes, among other things) and/or corrugators. In this regard, known corrugators utilize web product (e.g., liner) and flute medium to form corrugated web product (which may be formed into any number of layered corrugate, such as conventional corrugate (liner, flute medium, liner) or double-walled corrugate (liner, flute medium, liner, flute medium, and liner)). The formed corrugated web product may then be cut (e.g., scored, sliced, perforated, etc.) as needed to form a blank of the desired box assembly portion (e.g., any of the box assembly designs described herein). An example corrugator is further described in U.S. Publication No. 2019/0016081, which was filed Jul. 12, 2018, and entitled "Controls for Paper, Sheet, and Box Manufacturing Systems", the contents of which is incorporated by reference herein in its entirety.

Various examples of the operations performed in accordance with some embodiments of the present disclosure will now be provided with reference to FIGS. 12-13. In this regard, FIGS. 12-13 each illustrate a flowchart according to an example method for forming a box assembly, shipping the box assembly with a bag of liquid stored therein, and converting the inner portion into a bag-in-box dispenser according to example embodiments 200, 300. The operations illustrated in and described with respect to FIGS. 12-13 may, for example, be performed by, with the assistance of, and/or under the control of one or more of a user or a machine for performing the operation (e.g., a corrugator for forming the blanks, a box-forming machine for forming the box assembly or portions thereof, a bag loading machine for loading the bag into the inner portion, a sealing device for applying a seal to the box assembly, etc.).

Operation 202 may comprise forming the corrugated web product, and operation 204 may comprise forming the blanks for the box assembly, such as may include the top portion 10, the inner portion 20, and the bottom portion 30. As noted above, such operations may be performed by various known machines/devices, such as a corrugator.

Operation 206 may comprise erecting (e.g., forming) the top portion, which may occur using a box forming machine and/or manually via a user. Similarly, operation 208 may comprise erecting (e.g., forming), at least partially, the inner portion (e.g., the inner portion may be left with at least one opening for receiving the bag therein), which may also occur using a box forming machine and/or manually via a user. Likewise, operation 210 may comprise erecting (e.g., forming) the bottom portion, which may also occur using a box forming machine and/or manually via a user. Operations 206, 208, and 210 may be performed in any order.

Operation 212 may include inserting the bag of liquid into the inner portion, either manually or by using a machine. Operation 212 may be performed before operations 206 and 210. Operation 214 may include sealing the inner portion, such as via tape, adhesive, staples or with a sealing/joining machine. Operation 216 may include inserting the bottom of the inner portion into the bottom portion or inversely placing the opening of the bottom portion around the bottom of the inner portion. Operation 218 may include forming the completed box assembly with the stored bag of liquid therein by positioning the top portion thereover. Operation 218 may be performed before operation 216. In some embodiments, the operation 220 may include securing the top portion to the bottom portion, such as via tape, adhesive, etc. This may be completed by a machine/device and/or manually via a user.

Operation 222 may comprise shipping the box assembly with stored bag therein, such as using individual box shipping means described herein. Then, such as upon arrival at the final destination, operation 224 may comprise removing the top and bottom portions from the inner portion. In some embodiments, operation 224 may comprise only removing the top portion from the inner portion. Finally, operation 226 may comprise converting the inner portion into the bag-in-box dispenser, such as described further herein. This may be performed using a machine/device and/or via a user.

Likewise, with reference to FIG. 13, operation 302 may comprise forming the corrugated web product, and operation 304 may comprise forming the blanks for the box assembly, such as may include the top portion 10, the inner portion 20, and the bottom portion 30. As noted above, such operations may be performed by various known machines/devices, such as a corrugator.

Operation 306 may comprise erecting (e.g., forming) the top portion, which may occur using a box forming machine and/or manually via a user. Similarly, operation 308 may comprise erecting (e.g., forming), at least partially, the inner portion (e.g., the inner portion may be left with at least one opening for receiving the bag therein), which may also occur using a box forming machine and/or manually via a user. Likewise, operation 310 may comprise erecting (e.g., forming) the bottom portion, which may also occur using a box forming machine and/or manually via a user. Operations 306, 308, and 310 may be performed in any order.

Operation 312 may include inserting the bottom of the inner portion into the bottom portion or inversely placing the opening of the bottom portion around the bottom of the inner portion. Operation 312 may be performed before operations 306 and 310. Operation 314 may include inserting the bag of liquid into the inner portion, either manually or by using a machine. Operation 316 may include sealing the inner portion via tape, adhesive, staples or with a sealing/joining machine. Operation 318 may include forming the completed box assembly with the stored bag of liquid therein by positioning the top portion thereover. Operation 318 may be performed before operation 312. In some embodiments, the operation 320 may include securing the top portion to the bottom portion, such as via tape, adhesive, etc. This may be completed by a machine/device and/or manually via a user.

Operation 322 may comprise shipping the box assembly with stored bag therein, such as using individual box shipping means described herein. Then, such as upon arrival at the final destination, operation 324 may comprise removing the top and bottom portions from the inner portion. In some embodiments, operation 324 may comprise only removing the top portion from the inner portion. Finally, operation 326 may comprise converting the inner portion into the bag-in-box dispenser, such as described further herein. This may be performed using a machine/device and/or via a user.

CONCLUSION

Many modifications and other embodiments set forth herein may come to mind to one skilled in the art to which this disclosure pertains having the benefit of the teachings presented in the foregoing descriptions and the associated drawings. Therefore, it is to be understood that the embodiments of the present disclosure are not to be limited to the specific embodiments disclosed and that modifications and other embodiments are intended to be included within the scope of the present disclosure. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the present disclosure. In this regard, for example, different combinations of elements and/or functions than those explicitly described above are also contemplated within the scope of the present disclosure. Although specific terms are employed herein, they are used in a generic and descriptive sense only and not for purposes of limitation.

The invention claimed is:

1. A corrugated box assembly for shipping a bag of liquid stored therein, the box assembly comprising:

an inner portion comprising a plurality of walls, wherein:

the inner portion defines an interior configured to receive and store the bag of liquid, the inner portion includes a perforation feature defined by a series of perforations, the perforation feature is removable from a remainder of the inner portion, and the inner portion is convertible into a bag-in-box dispenser;

a first outer shell portion comprising a plurality of walls, wherein the first outer shell portion defines an opening configured to receive and sized to fit a first part of the inner portion when formed; and a second outer shell portion comprising a plurality of walls, wherein the second outer shell portion defines an opening configured to receive and sized to fit a second part of the inner portion when formed, wherein, when the formed inner portion is placed within the first outer shell portion and the second outer shell portion, the first outer shell portion and the second outer shell portion are configured to be secured together to store the inner portion therein.

2. The box assembly of claim 1, wherein the second part is the remaining part of the inner portion excluding the first part.

3. The box assembly of claim 1, wherein the perforation feature defines a portion of a first wall of the plurality of walls of the inner portion that is sized to enable a dispensing tap of the stored bag of liquid to extend therethrough when the inner portion is converted into the bag-in-box dispenser.

4. The box assembly of claim 3, wherein the perforation feature is positioned along an edge of the first wall such that when the inner portion is converted into the bag-in-box dispenser and rotated, the dispensing tap is positioned lower than most of the liquid of the bag.

5. The box assembly of claim 1, wherein:

the perforation feature is on both a first wall of the plurality of walls of the inner portion and a first flap of the inner portion extending from the first wall, and the perforation feature is continuous across a fold line between the first wall and the first flap.

6. The box assembly of claim 5, wherein:

a second flap extends from a second wall of the inner portion that is adjacent to the first wall, and the second flap of the inner portion defines a modified shape such that when the second flap and the first flap are folded to form a first inner portion closure, a user can access a dispensing tap of the stored bag of liquid within the inner portion around or through the modified shape upon removal of the perforation feature.

7. The box assembly of claim 6, wherein:

the modified shape defines a cut-out feature, the cut-out feature of the second flap defines a portion of the second flap that is at least one of pre-removed and removable from the remainder of the second flap and is positioned on the second flap to align with a portion of the perforation feature on the first flap so as to enable a user to access the dispensing tap of the stored bag of liquid within the inner portion upon removal of the perforation feature.

8. The box assembly of claim 1, wherein:

the first outer shell portion and the second outer shell portion are corrugated along a first direction, the inner portion is corrugated along a second direction, and the first direction is different from the second direction.

9. The box assembly of claim 8, wherein the first direction is about 90° different from the second direction.

10. The box assembly of claim 1, wherein:

the inner portion further defines a finger access feature positioned adjacent to the perforation feature, and the finger access feature is at least partially defined by a separate series of perforations and is removable separately from the perforation feature to enable easier access for a user to remove the perforation feature.

11. The box assembly of claim 1, wherein the inner portion defines a side flap that is attached to an outside surface of one of the plurality of walls of the inner portion.

12. The box assembly of claim 1, wherein the box assembly is configured to store the bag of liquid with volume ranging from 3 gallons to 6 gallons and keep the bag from damage or leaking during individual box shipping.

13. The box assembly of claim 12, wherein the box assembly is designed to store the bag of liquid and pass individual box shipping test standards, including at least the 2018 International Safe Transit Association (ISTA) Series 6-Amazon.com-Ship In Own Container (SIOC) test protocol for at least one of Type A or Type B.

14. The box assembly of claim 1, wherein the box assembly is designed to survive individual box shipping such that the bag of liquid is free of damage or leaking so as to enable conversion of the inner portion into the bag-in-box dispenser thereafter.

15. A system including the box assembly of claim 1, wherein the system further includes the bag of liquid including a dispensing tap, wherein the bag of liquid is stored within the inner portion of the box assembly.

16. A system of blanks formed of corrugate for a corrugated box assembly for shipping a bag of liquid stored therein, the system comprising:

an inner portion comprising a plurality of panels and convertible into a bag-in-box dispenser, wherein:

the panels are configured to fold to form an interior surrounded by a first inner portion part and a second inner portion part, the interior configured to receive and store the bag of liquid when the inner portion is formed, and the inner portion includes a perforation feature defined by a series of perforations on at least one of a first panel of the plurality of panels and a first flap extending from the first panel so as to be removable from a remainder of the inner portion;

a first outer shell portion comprising a plurality of panels, wherein the panels are configured to fold to form an opening sized to fit around the first inner portion part when the inner portion is formed; and a second outer shell portion comprising a plurality of panels, wherein the panels are configured to fold to form an opening sized to fit around the second inner portion part when the inner portion is formed.

17. The system of blanks of claim 16, wherein the perforation feature defines a portion of at least one of the first panel and the first flap that is sized to enable a dispensing tap of the stored bag of liquid within the formed inner portion to extend therethrough when the inner portion is converted into the bag-in-box dispenser.

18. The system of blanks of claim 17, wherein the perforation feature is positioned along an edge of at least one of the first panel and the first flap such that when the inner portion is converted into the bag-in-box dispenser and rotated, the dispensing tap is positioned lower than most of the liquid of the bag.

19. The system of blanks of claim 16, wherein:

the perforation feature is on both the first panel and the first flap, and the perforation feature is continuous across a fold line between the first panel and the first flap.

20. The system of blanks of claim 16, wherein:

the first outer shell portion and the second outer shell portion are corrugated along a first direction, the inner portion is corrugated along a second direction, and the second direction is different from the first direction.

21. The system of blanks of claim 20, wherein the first direction is about 90° different from the second direction.

22. A method of manufacturing blanks for a corrugated box assembly for shipping a bag of liquid stored therein, the method comprising:

forming corrugated web product;

cutting out an inner portion from the corrugated web product, wherein:

the inner portion comprises a plurality of panels and is convertible into a bag-in-box dispenser, the panels are configured to fold to form an interior surrounded by a first inner portion part and a second inner portion part, the interior is configured to receive and store the bag of liquid when the inner portion is formed, and the inner portion includes a perforation feature removable and defined by a series of perforations on at least one of a first panel of the plurality of panels and a first flap extending from the first panel;

cutting out a first outer shell portion from the corrugated web product, wherein the first outer shell portion comprises a plurality of panels configured to fold to form an opening sized to fit around the first inner portion part when the inner portion is formed; and cutting out a second outer shell portion from the corrugated web product, wherein the second outer shell portion comprises a plurality of panels configured to fold to form an opening sized to fit around the second inner portion part when the inner portion is formed.

23. The method of claim 22, further comprising:

erecting the inner portion;

erecting the first outer shell portion; and erecting the second outer shell portion.

24. The method of claim 23, further comprising:

inserting the bag of liquid into the interior of the inner portion;

sealing the interior of the inner portion;

sliding the second inner portion part into the second outer shell portion; and sliding the first outer shell portion over the first inner portion part.

25. The method of claim 24, further comprising:

sealing the first outer shell portion to the second outer shell portion.

* * * * *